US007565924B2

(12) United States Patent
Gagnon et al.

(10) Patent No.: US 7,565,924 B2
(45) Date of Patent: Jul. 28, 2009

(54) PRESSURE EQUILIZING SYSTEM

(75) Inventors: Martin Gagnon, Saint-Charles-de-Drummond (CA); Daniel Marcoux, Saint-Charles-de-Drummond (CA); Michel Julien, Drummondville (CA); Jean-Bernard Piaud, Rock Forest (CA); Eric Charlebois, Saint-Nicéphore (CA)

(73) Assignee: Venmar Ventilation Inc., Drummonville (CA)

( * ) Notice: Subject to any disclaimer, the term of this patent is extended or adjusted under 35 U.S.C. 154(b) by 454 days.

(21) Appl. No.: 10/823,588

(22) Filed: Apr. 14, 2004

(65) Prior Publication Data

US 2005/0133196 A1 Jun. 23, 2005

(30) Foreign Application Priority Data

Dec. 23, 2003 (CA) ..... 2454056

(51) Int. Cl.
*F24F 7/007* (2006.01)
*F24F 3/147* (2006.01)
*F24F 11/02* (2006.01)

(52) U.S. Cl. ..... 165/54; 165/909; 165/282; 165/286; 454/232; 454/237; 454/239; 454/252

(58) Field of Classification Search ..... 165/54, 165/909, 282, 286; 454/232, 237, 239, 252
See application file for complete search history.

(56) References Cited

U.S. PATENT DOCUMENTS 1,825,498 A * 9/1931 Wogan ..... 165/54
4,550,773 A * 11/1985 Martin ..... 165/54
5,193,610 A 3/1993 Morissette et al.
5,193,630 A 3/1993 Cane
5,257,736 A * 11/1993 Roy ..... 165/54
5,771,707 A 6/1998 Lagace et al.
6,176,305 B1 * 1/2001 Haglid ..... 165/54
6,209,622 B1 4/2001 Lagace et al.
6,257,317 B1 7/2001 DeGregoria et al.
6,289,974 B1 9/2001 DeGregoria et al.
2003/0013407 A1 * 1/2003 Gagnon et al. ..... 454/237

FOREIGN PATENT DOCUMENTS

JP 57099411 A * 6/1982
JP 03105136 A * 5/1991
JP 05164360 A * 6/1993
JP 07042990 A * 2/1995
JP 08068553 A * 3/1996
JP 09159209 A * 6/1997
JP 2000111096 A * 4/2000

* cited by examiner

*Primary Examiner*—John K Ford

(57) ABSTRACT

An air handling system for an indoor space comprising a first forced indoor air treatment component, an input indoor air duct element and an output treated air duct element respectively coupling said first forced indoor air treatment component to said indoor space, a second forced air treatment component a stale air duct element coupled to said second forced air treatment component and to said input indoor air duct, a return air duct element coupling said second forced air treatment component to said output treated air duct element characterized in that said system comprises a secondary air path means for coupling said return air duct element to said input indoor air duct element.

20 Claims, 16 Drawing Sheets

PRESSURE EQUILIZING SYSTEM

BACKGROUND

The present invention relates to an air handling system (i.e. for pressure equalization, attenuation, redistribution or the like) which has a forced air treatment unit or component and, for example, a forced air ventilator unit or component. These air handling units are coupled to a common duct system. These air handling units may take any (known) form. These air handling units are associated with air blower means which are commonly provided with electric motors which may be selectively or independently activated by (known types of) control mechanisms for controlling the various motors for the various operation modes of the air handling system. In the following, particular attention will be given, by way of example, to systems with air ventilators.

Buildings such as houses, apartment buildings, etc., are quite often constructed or renovated so as to be air tight in addition to being insulated so as to facilitate heating, humidifying and/or cooling of the indoor environment provided therein. While such air tight insulation construction provides heating/cooling cost benefits, such construction can also unfortunately prevent or inhibit fresh air from entering a building. The lack of fresh air may lead to the accumulation of unwanted elements in the indoor air, such as particles of dust, cooking vapours and odours as well as other types of indoor air pollutants.

As a result, buildings are either being renovated or initially constructed so as to be outfitted with one or more air ventilator units which can introduce outside fresh air into the indoor space(s) of buildings, provide purification of the air, exhaust indoor air to the outside environment or a combination thereof, etc. Examples of known types of ventilation devices are illustrated in U.S. Pat. Nos. 5,193,630, 5,771,707, 6,209,622, 6,257,317, 6,289,974 as well as in U.S. patent application Ser. No. 10/158,492 published under no. 20030013407; the entire contents of each of these patent documents is incorporated herein by reference.

An air duct system of an existing building may already be connected to an air treatment unit which either heats, humidifies and/or cools air for delivery to the indoor space(s) of the building; examples of such air treatment units include forced air furnaces, air conditioners (i.e. coolers), humidifiers, etc. Air treatment may thus comprise an air heating stage, an air cooling stage, etc. For an existing building, indoor air may be delivered to the air treatment unit by the air supply or input portion of the air duct system and the heated or cooled air may then be circulated throughout the building through the return or output portion of the air duct system. Thus, in the case of an existing building, a relatively efficient way to integrate an air ventilator unit with the building is to exploit the existing air duct system (i.e. exploit existing building air duct(s)) so as to form an integrated air handling system. A building may of course be initially constructed with an air ventilator unit being connected to such a common duct work system.

An integrated air handling system may be configured so as to have a ventilation mode (i.e. ventilation only), an air treatment mode (e.g. heating only) and a combination mode (e.g. simultaneous heating and ventilation). During ventilation mode operation only, the ventilator blower means may be activated (e.g. an electric motor thereof is electrically energized); during air treatment mode only, the air treatment air blower means may be activated (e.g. an electric motor of a furnace air blower means is electrically energized); and during combination mode both the ventilator blower means and the air treatment air blower means may be simultaneously activated (e.g. an electric motor thereof is electrically energized). An electric motor may be electrically energized by being electrically connected to a source of electrical power or energy via appropriate electrical wiring and electric switching assembly (i.e. in any known manner).

There are, however, some problems which may arise from hooking up an air ventilator unit to an air duct system connected to an air treatment unit such as a furnace unit. For example, it has been proposed to couple the stale air inlet and fresh air outlet of the air ventilator unit on the same (e.g. upstream) side of the duct system feeding air to the air treatment unit. However, if the stale air inlet and fresh air outlet of the air ventilator unit, are coupled to the air duct system too closely together, then during ventilation mode operation when the air treatment unit is off (e.g. the furnace blower mean is not energized), a short circuiting of the air flows entering and exiting the air ventilator unit may occur. This is not desirable because it leads to a portion of the air being treated over and over again by the air ventilator unit.

The simplest proposed solution to this problem is to provide a blocking system between the air inlet and the outlet of the air ventilator unit. In this way the short circuiting is prevented. This solution can, however, cause additional problems related to impaired flow of air to the air treatment unit. The reason for this is that air treatment units (e.g. forced air furnace units) usually drive air through the air circulation system at much higher volumes than that which pass through an air ventilator unit. If the passage to the air treatment unit were to be blocked between the air inlet and outlet of the air ventilator unit, then, when running both the air treatment unit and the air ventilator unit simultaneously, all the air would have to pass through the air ventilator unit and the air treatment unit might then be unable to operate at its full capacity and lead to equipment break down; a reduced air flow through an air treatment unit such as a furnace for example may not only lead to equipment breakdown but may also result in overheating of the furnace which at worst, may cause fire ignition In order to inhibit such short circuiting it is possible to place the air ventilator unit in parallel with an air treatment unit such as a furnace unit, namely to couple the stale air inlet and fresh air outlet of the air ventilator unit to the air duct system respectively upstream of the furnace and downstream of the furnace, e.g on opposite sides of the furnace unit. This coupling system may however, also lead to a reduced air flow problem, when both the furnace unit and air ventilator unit are operating at the same time. In this configuration the air ventilator unit will siphon off some of the air normally destined to pass through the furnace unit; this reduced air flow through the furnace may also result in overheating of the furnace with the attendant fire danger.

As can be seen from the above, there is an ongoing need for a system for delivering fresh air to an indoor environment.

It would be advantageous to have an air handling system having an air treatment unit or component as well as an air ventilator unit or component which are connected or coupled to a common duct system so as to inhibit short circuiting of air flow through the air ventilator unit during a ventilation mode operation thereof.

It would also be advantageous to have an air handling system having an air treatment unit or component as well as an air ventilator unit or component which are connected or coupled to a common duct system so as to be able to attenuate or modulate reduced air flow to the air treatment unit during combination mode operation of such an integrated air handling system.

It would be advantageous to have an air handling system able to adjust air flow in reaction to the air pressure in the secondary duct system associated with a second air handling unit or component so as to be able to equilibrate the resulting airflow entering the air treatment component and inhibit or avoid excessive choking off of the original equipment in place.

It in particular would be advantageous to have an air handling system able to adjust air flow in reaction to the air pressure in the secondary duct system associated with the ventilation unit or component so as to be able to equilibrate the resulting airflow entering the air treatment component so as to inhibit or avoid excessive choking of the air treatment component, i.e. choking off of the original equipment (e.g. furnace) in place.

STATEMENT OF INVENTION

The present invention in one aspect provides an air handling system for an indoor space comprising

- a first forced indoor air treatment component,
- an input indoor air duct element and an output treated air duct element respectively coupling said first forced indoor air treatment component to said indoor space,
- a second forced air treatment component
- a stale air duct element coupled to said second forced air treatment component and to said input indoor air duct element,
- a primary output air duct element coupling said second forced air treatment component to said output treated air duct element characterized in that said system comprises a further secondary output air path means coupling said primary output air duct element to said input indoor air duct element. In accordance with the present invention the further secondary output air path means may comprise an air duct element having a first end coupled to the primary output air duct element and a second end coupled to the input indoor air duct element.

The first forced indoor air treatment component may, for example, be a furnace, an air conditioner (i.e. cooler means) or the like. The second forced air treatment component may, for example, be a humidifier, an air exchanger, optional filters or other similar device; the secondary air treatment component may in particular be a forced fresh air ventilator component.

The present invention thus provides, in particular, an air handling system for an indoor space comprising

- a forced air treatment component (e.g. forced air furnace component),
- an input indoor air duct element (i.e. air path element) and an output treated (e.g. heated) air duct element (i.e. air path element) respectively coupling said forced air treatment component (e.g. furnace component) to said indoor space,
- a forced fresh air ventilator component for discharging stale air from the indoor space (i.e. at least a portion of stale air entering the input indoor air duct) to an outdoor environment and for replacing the discharged air with make-up air from the outdoor environment, said fresh air ventilator component comprising stale air input means coupled to a stale air output means and fresh make-up air input means coupled to a fresh air output means
- a stale air duct element (i.e. air path element) coupled to said stale air input means and to said input indoor air duct element,
- a primary fresh air duct element (i.e. air path element) coupling said fresh air output means to said output treated (e.g. heated) air duct element characterized in that said system comprises a further secondary fresh air path means coupling said fresh air output means to said input indoor air duct element. In accordance with the present invention the further secondary fresh air path means may comprise an air duct element having a first end coupled to the fresh air output means and a second end coupled to said input indoor air duct element.

In accordance with another aspect the present invention provides an air manifold component or element, for an air handling system for an indoor space said air handling system comprising

- a first forced indoor air treatment component,
- an input indoor air duct element and an output treated air duct element respectively coupling said first forced indoor air treatment component to said indoor space,
- a second forced air treatment component
- a stale air duct element coupled to said second forced air treatment component and to said input indoor air duct element, a primary output air duct element coupling said second forced air treatment component to said output treated air duct element, said primary output air duct element comprising said manifold component, and

- a further secondary output air path means for coupling said primary output air duct element to said input indoor air duct element, wherein said further secondary output air path means comprises an air duct element having a first end for being coupled to said manifold component and a second end for being coupled to said input indoor air duct element, said manifold component or element comprising an air inlet, a first air outlet, a second air outlet, a first damper element associated with said first air outlet, a second damper element associated with said second air outlet, said air inlet being configured for being coupled to said second forced air treatment component, said first air outlet being configured for being coupled to said output treated air duct element, and said second outlet being configured for being coupled to said first end of said further secondary output air path means.

It is to be understood herein that a reference to a forced air treatment component (e.g. a forced air furnace component) or a forced fresh air ventilator component is a reference to a component through which air is to be forced or induced to pass under the influence of appropriate (i.e. known) air blower means, i.e. in order to heat, humidify, cool and/or freshen air destined to pass on to an indoor space(s). Thus it is to be understood herein that an air blower means may be incorporated directly in the forced air treatment component (e.g. a forced air furnace component) and/or the fresh air ventilator component (i.e. in any known manner). Alternatively, it is to be understood that an air blower means may comprise one or more stand alone blowers which are suitably (i.e. in any known fashion) incorporated into the duct system, per se, (i.e. in any known manner) for influencing air to pass through a forced air treatment component (e.g. a forced air furnace component) or a forced fresh air ventilator component.

In accordance with the present invention the secondary air path means may comprise a reflux air duct element (i.e. air path element) coupled to the return air duct element and to the input indoor air duct element.

In accordance with the present invention the air handling system may comprise any type of (known) air flow control means for inhibiting air flow through the secondary air path means. For example, the reflux air duct element may be configured to have a cross section transverse to the flow of air there through which is sized in relation to the cross section of the other duct elements whereby a desired or suitable air flow through the reflux duct element may be obtained relative to or in relation to air flow through other of the duct elements.

Advantageously however the air handling system may comprise any type of (known) air flow control means which exploits damper type element(s) for air flow control. Damper elements may be associated for example with the ventilator component itself. Alternatively damper elements may be associated with the reflux air duct element and/or the return air duct element. As additional alternative damper elements may be associated with the ventilator component, the reflux air duct element and/or the return air duct element. An air flow control means of the present invention may take any form whatsoever keeping in mind the purpose thereof, i.e. to inhibit backflow of air during a ventilation cycle and/or attenuate air flow restriction to an air treatment unit such as for example to a furnace. Thus for example a damper element may be air pressure displaceable from a blocking to a non-blocking configuration by exploiting appropriately configured biasing mechanisms such as springs, gravity counterweights, etc.; the exact nature of the biasing mechanism may of course be determined empirically for any given air handling system (i.e. keeping in mind the comments herein). Alternatively, a damper element may be displaceable by means of an electric motor suitably connected to the damper and to a source of electrical power, i.e. via appropriate electrical wiring and electric switching assembly (i.e. in any known or desired manner). A motor actuated system would of course be configured to provide an air flow pattern the same as provided by the air pressure activated system. An air handling system may of course exploit both types of damper displacement as desired or necessary.

Thus an air handling system in accordance with the present invention may comprise a first air flow control means comprising a first damper element associated with said primary output (e.g. fresh) air duct, said first damper element being displaceable between a blocking configuration (i.e. a closed configuration) and a non-blocking configuration (i.e. a open configuration), a second air flow control means comprising a second damper element associated with said further secondary output (e.g. fresh) air path means, said second damper element being displaceable between a blocking configuration (i.e. an closed configuration) and a non-blocking configuration (i.e. an open configuration), and wherein in said respective blocking configuration, said first and second damper elements are respectively disposed to close off said primary output (e.g. fresh) air duct and said further secondary output (e.g. fresh) air path means to air flow, and in said respective non-blocking configuration, said first and second damper elements are respectively disposed such that air is able to circulate through said primary output (e.g. fresh) air duct and said further secondary output (e.g. fresh) air path means.

In accordance with the present invention, for combination mode operation, the second air flow control means may configured such that, when a furnace air blower means associated with said forced air treatment component (e.g. forced air furnace component) and a ventilation air blower means associated with said forced fresh air ventilator component are both activated (e.g. an electric motor thereof is electrically energized), said second damper element is in said non-blocking configuration.

In accordance with the present invention, for ventilation mode operation, the first and said second air flow control means may each be configured such that, when only the ventilation air blower means is activated (e.g. an electric motor thereof is electrically energized), said first damper element is in said non-blocking configuration and said second damper element is in said blocking configuration.

In the following, for purposes of illustration, reference will, unless the contrary is indicated, be to an air handling system comprising an air treatment component which is a forced air furnace component and wherein the output treated air duct element is an output heated air duct element.

In accordance with the present invention, the first and the second air flow control means may each be configured such that, when only the furnace air blower means is activated (e.g. an electric motor thereof is electrically energized), the first damper element and the second damper element are each in said blocking configuration.

In accordance with the present invention, the first and the second air flow control means may each be configured such that, when a furnace air blower means associated with said forced air furnace component and a ventilation air blower means associated with said forced fresh air ventilator component are both activated (e.g. an electric motor thereof is electrically energized), the first damper element and the second damper element are each in said non-blocking configuration.

In accordance with the present invention, the first and the second air flow control means may each be configured such that, when only the ventilation air blower means is activated (e.g. an electric motor thereof is electrically energized), the first damper element is in said non-blocking configuration and the second damper element is in said blocking configuration.

In accordance with the present invention, the first and the second air flow control means may each be configured such that, when both the furnace air blower means and the ventilation air blower means are unactivated (e.g. an electric motor thereof is electrically unenergized), the first damper element and the second damper element are each in said blocking configuration.

In accordance with the present invention, the stale air duct element may be coupled to the input indoor air duct element at a first position upstream of said furnace and said reflux air duct may be coupled to said the input indoor air duct element at a second position downstream of said first position and upstream of said furnace.

In accordance with the present invention the first air flow control means may comprise a first biasing element biasing said first damper element in said blocking configuration and wherein the second air flow control means may comprise a second biasing element biasing said second damper element in said blocking configuration.

In accordance with the present invention, the primary output (e.g. fresh) air duct may comprise a manifold component or element. The manifold (or enclosure) element may comprise an air inlet, a first air outlet and a second air outlet. The air inlet may be coupled to the return air output means of a forced fresh air ventilator component. The first air outlet may be coupled to the treated (e.g. heated) air duct element i.e. so as to define an upstream connection between the manifold element and the treated (e.g. heated) air duct. The further secondary output (e.g. fresh) air path means may be coupled to the second air outlet. The first damper element may be associated with the upstream connection. More particularly, a first damper element may be associated with the first outlet. Similarly a second damper may be associated with the second outlet.

In accordance with the present invention, the forced fresh air ventilator component may comprise a heat recovery means for exchanging heat between the discharged air and the make-up air; see the above mentioned patents.

A system in accordance with the present invention, may comprise (known) control means electrically coupled to the furnace blower means and the ventilation air blower means for independently electrically actuating same. An electric motor of a blower means may be electrically energized by being electrically connected to a source of electrical power or energy via appropriate electrical wiring and electric switching assembly (i.e. in any known manner).

In accordance with the present invention, the first air flow control means and the second air flow control means may each be configured such that said first damper element and said second damper element are each respectively air pressure displaceable from said blocking configuration to said non-blocking configuration.

In drawings which illustrate example embodiment(s) of the present invention:

Figure 8:
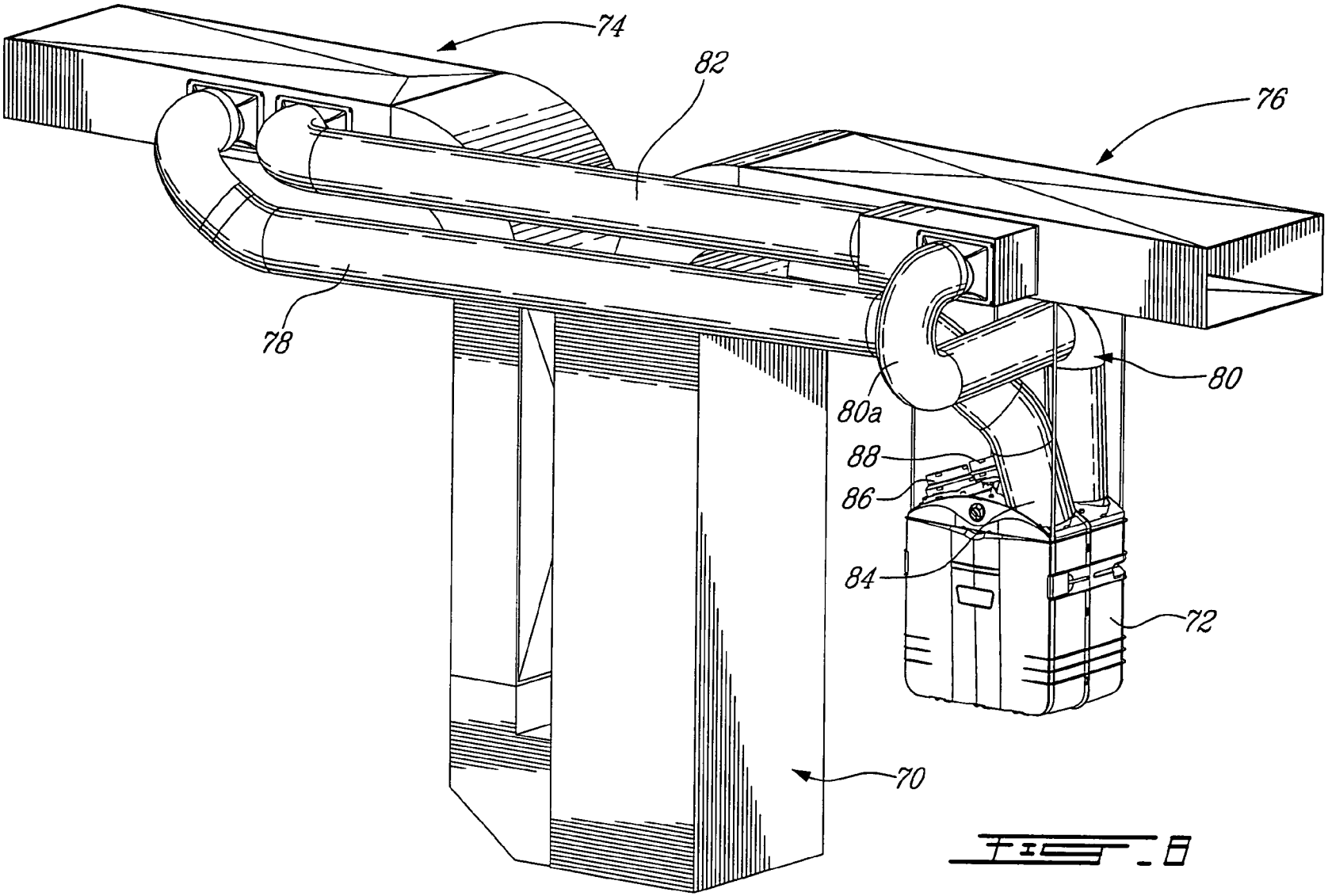
FIG. 8 is a schematic illustration of an air handling system in accordance with the present invention wherein the various components and elements are shown in more detail.
Figure 14:
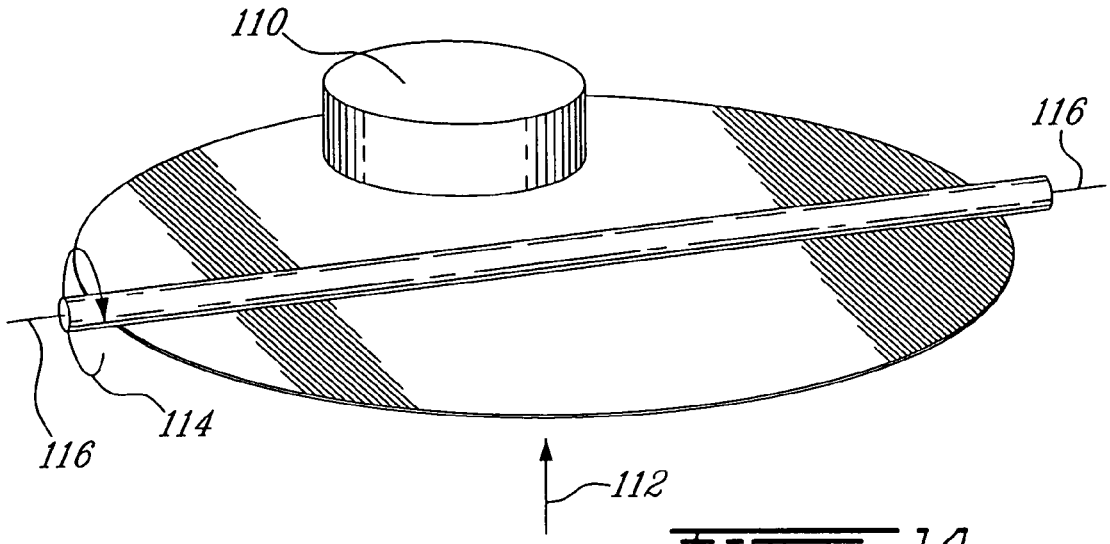
Figure 14A:
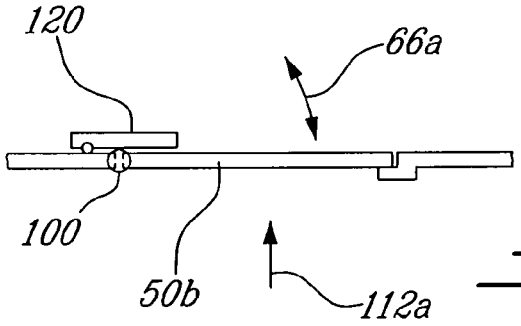
Figure 15:
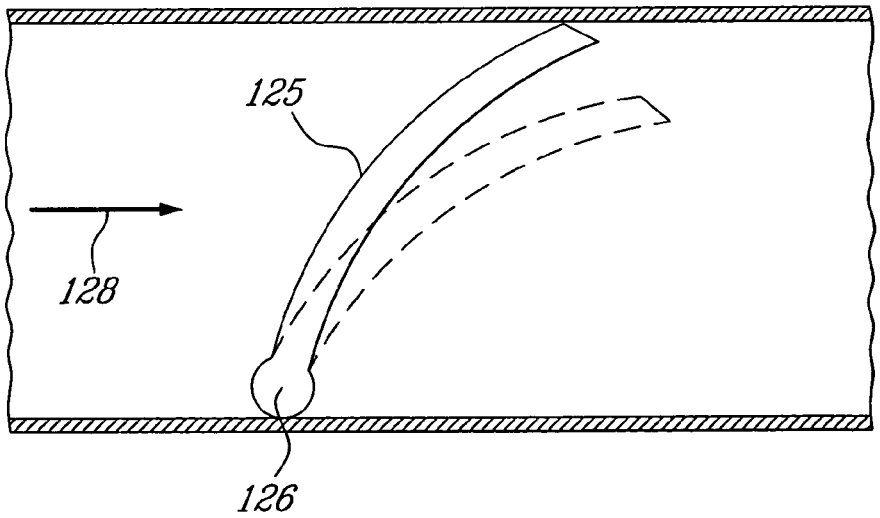
Figure 16:
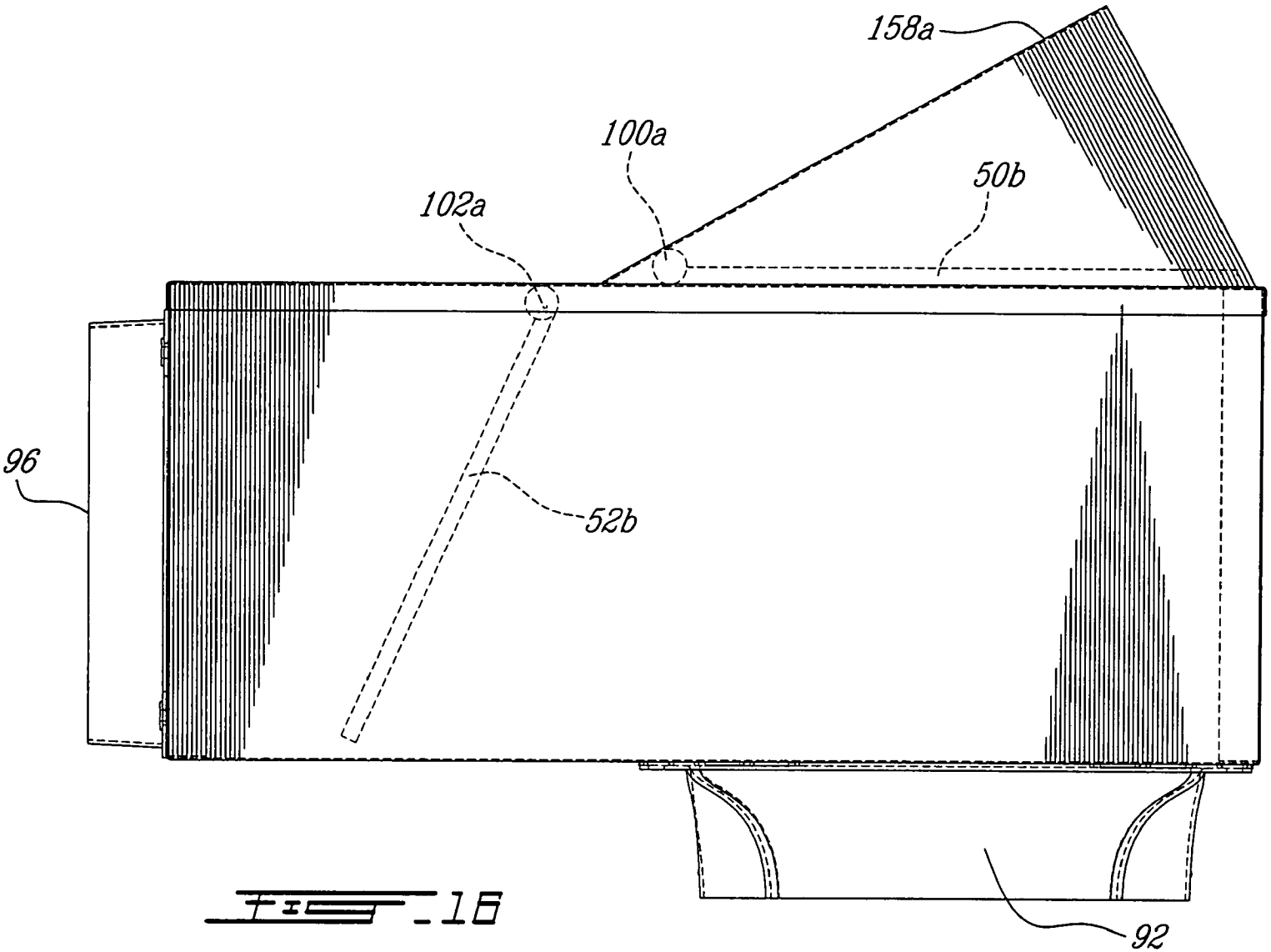
Figure 17:
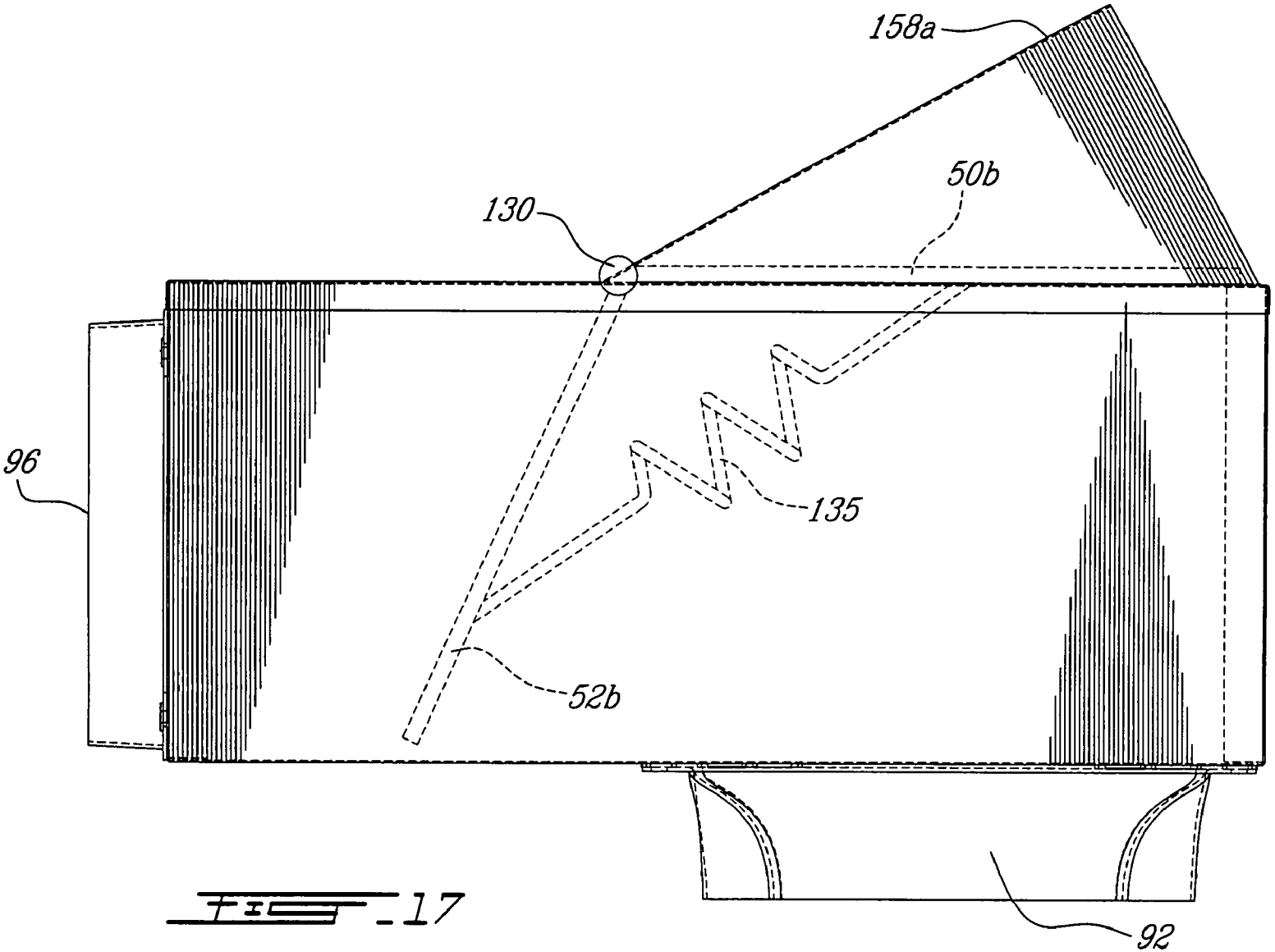
Figure 18:
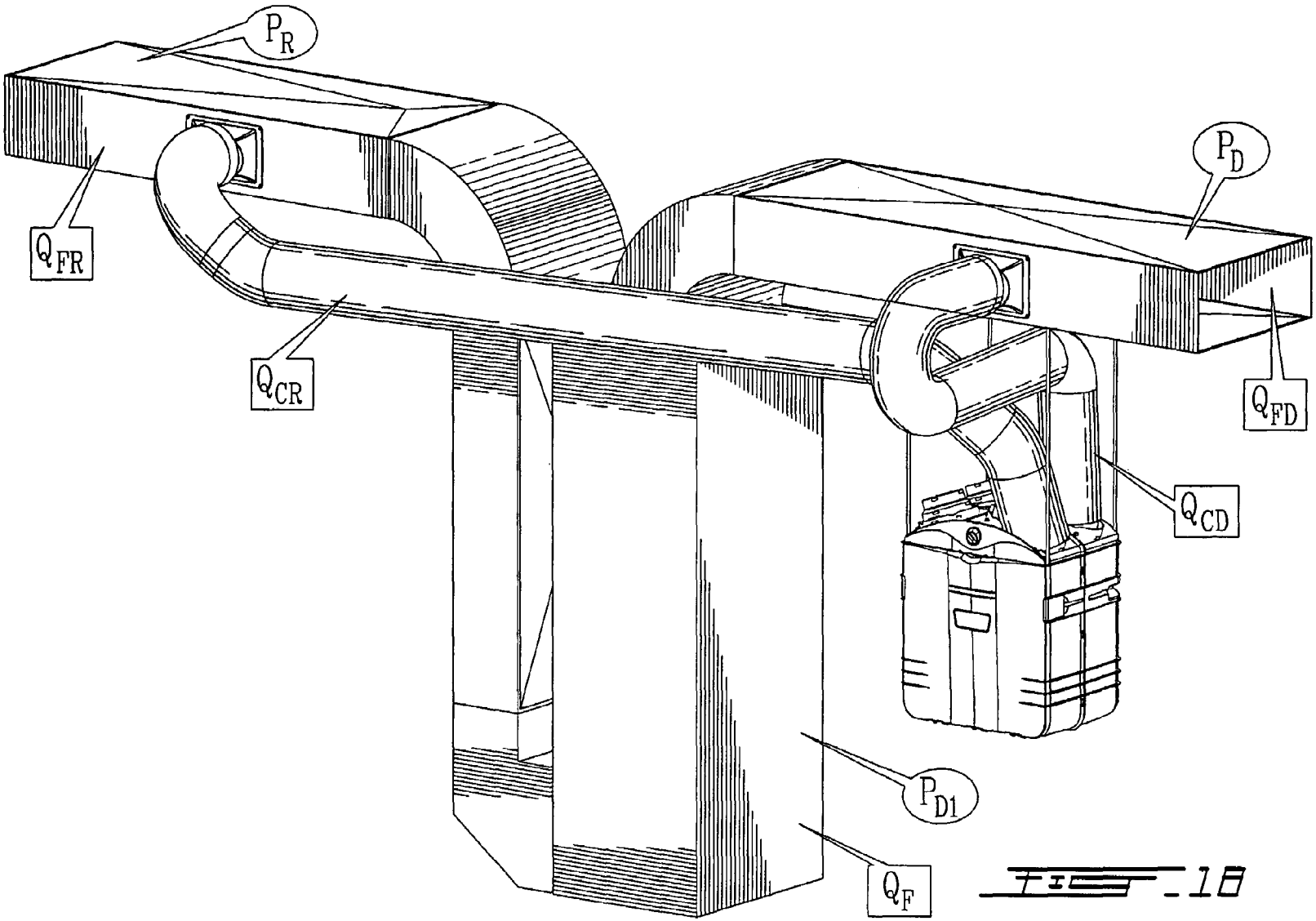
Figure 19:
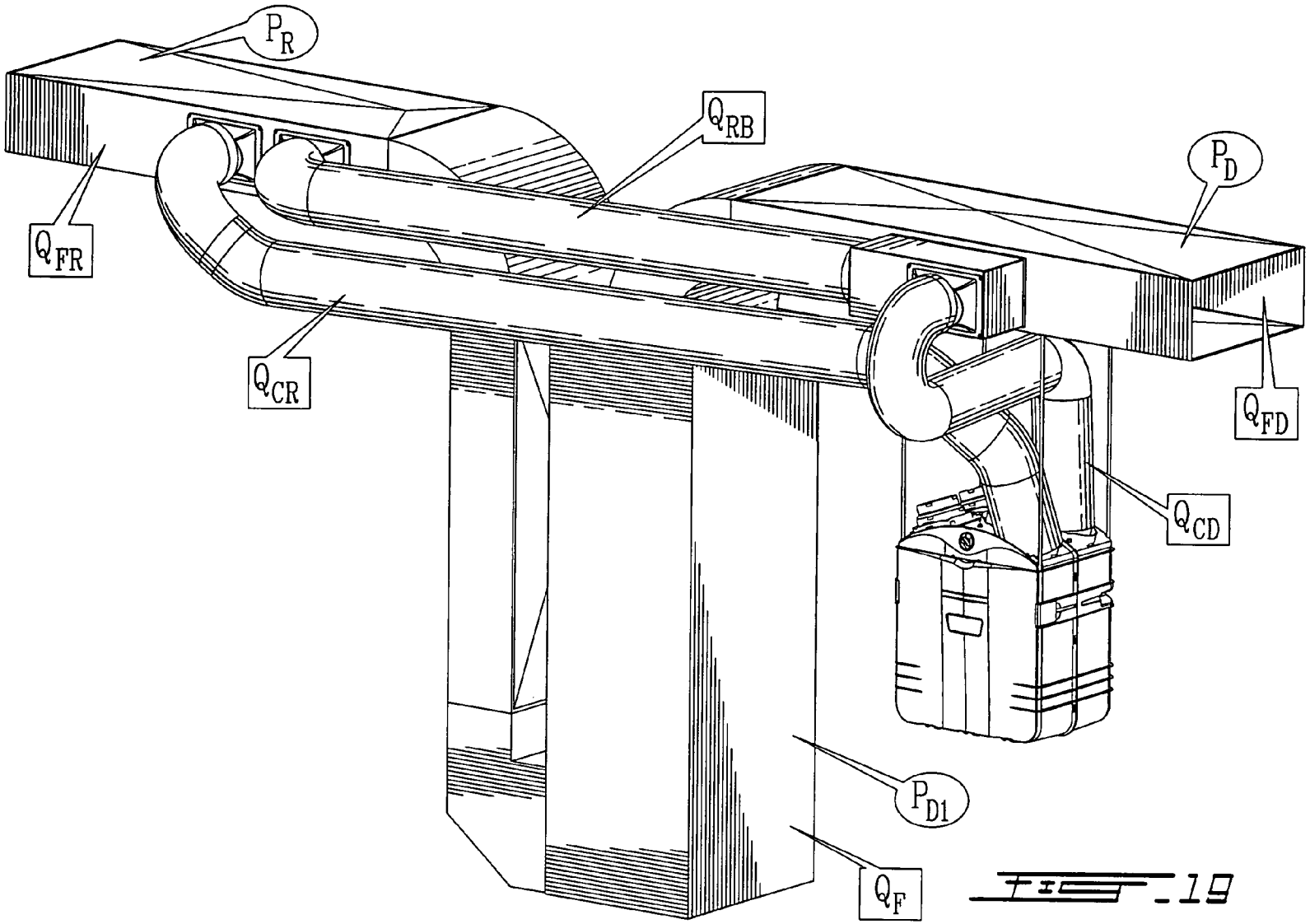
Figure 20:
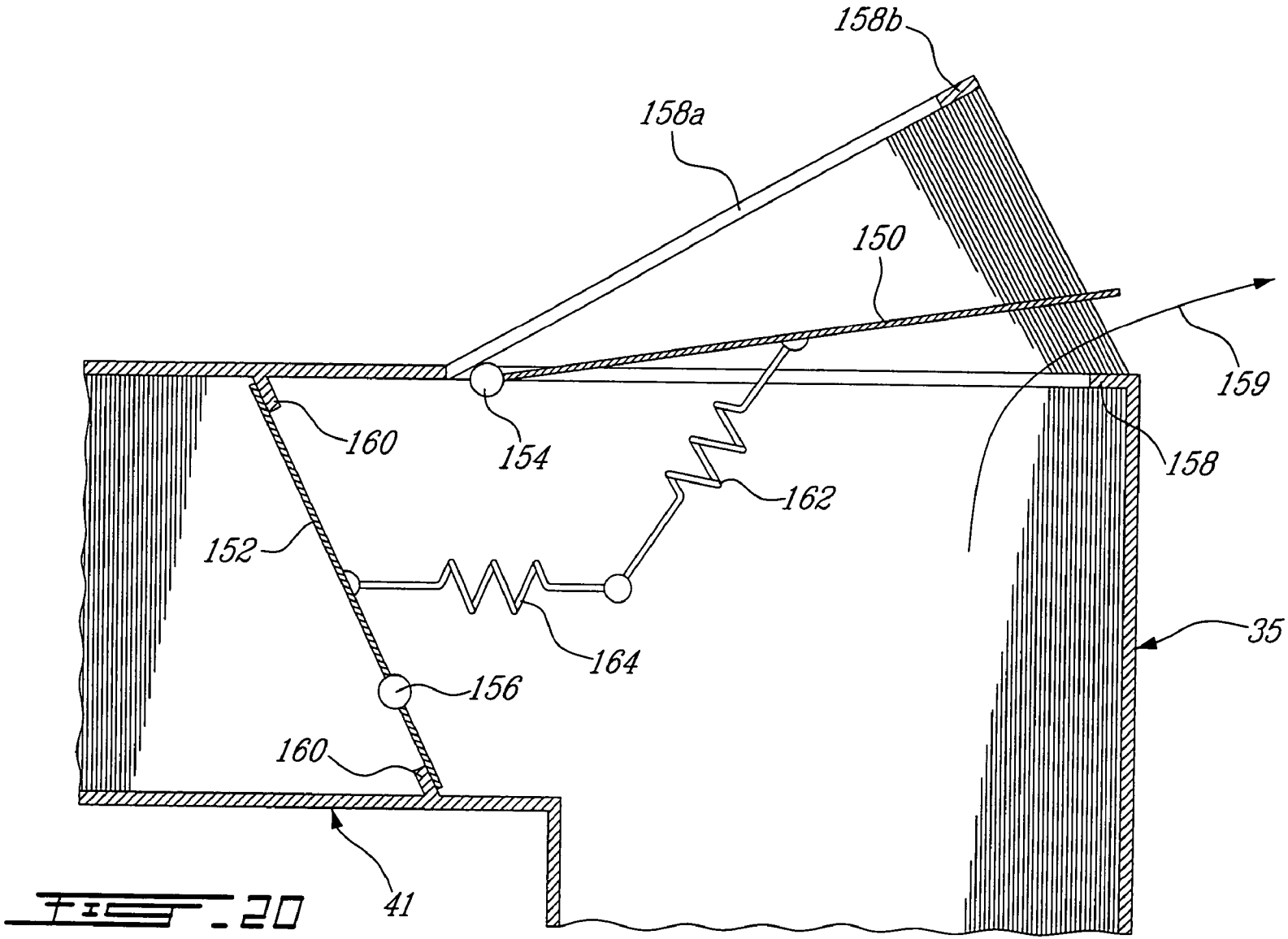

FIGS. 13*a-d* is a schematic top view from above of alternative damper forms for the first and second damper elements;

FIG. 14 is a schematic perspective top view from above of an example air pressure displaceable damper form for the first and second damper elements wherein biasing is provided by a gravity weight;

FIG. 14*a* is a schematic side view cross section of a damper element biased by a leaf spring in a blocking configuration in the first outlet opening;

FIG. 15 is a schematic cross sectional view of damper forms for the first and second damper elements wherein one of the damper element forms is of a flexible material of a kind such that the damper has a built in bias function;

FIG. 16 is a schematic top cross sectional view of an example embodiment of a manifold element having first and second damper elements, the first damper element associated with an outlet of the manifold element the other second damper element being disposed within the manifold element internally spaced apart from the other outlet of the manifold element which is coupled to the reflux duct element;

FIG. 17 is a schematic view of an alternate example embodiment of a manifold element as shown in FIG. 16 but wherein the damper elements have a common bias member;

FIG. 18 is a schematic illustration of an air handling system as set forth in FIG. 8 but without the reflux air duct element which was subject to testing for the results in table 1;

FIG. 19 is a schematic illustration of an air handling system as set forth in FIG. 8 (i.e. with the reflux air duct element) which was subject to testing for the results in table 2; and FIG. 20 is a partial schematic view of a further alternate example embodiment of a manifold element (used for the system shown in FIG. 19) as shown in FIG. 16 but wherein the damper elements have a separate bias members connected to a common anchor point within the manifold element.

Figure 1:
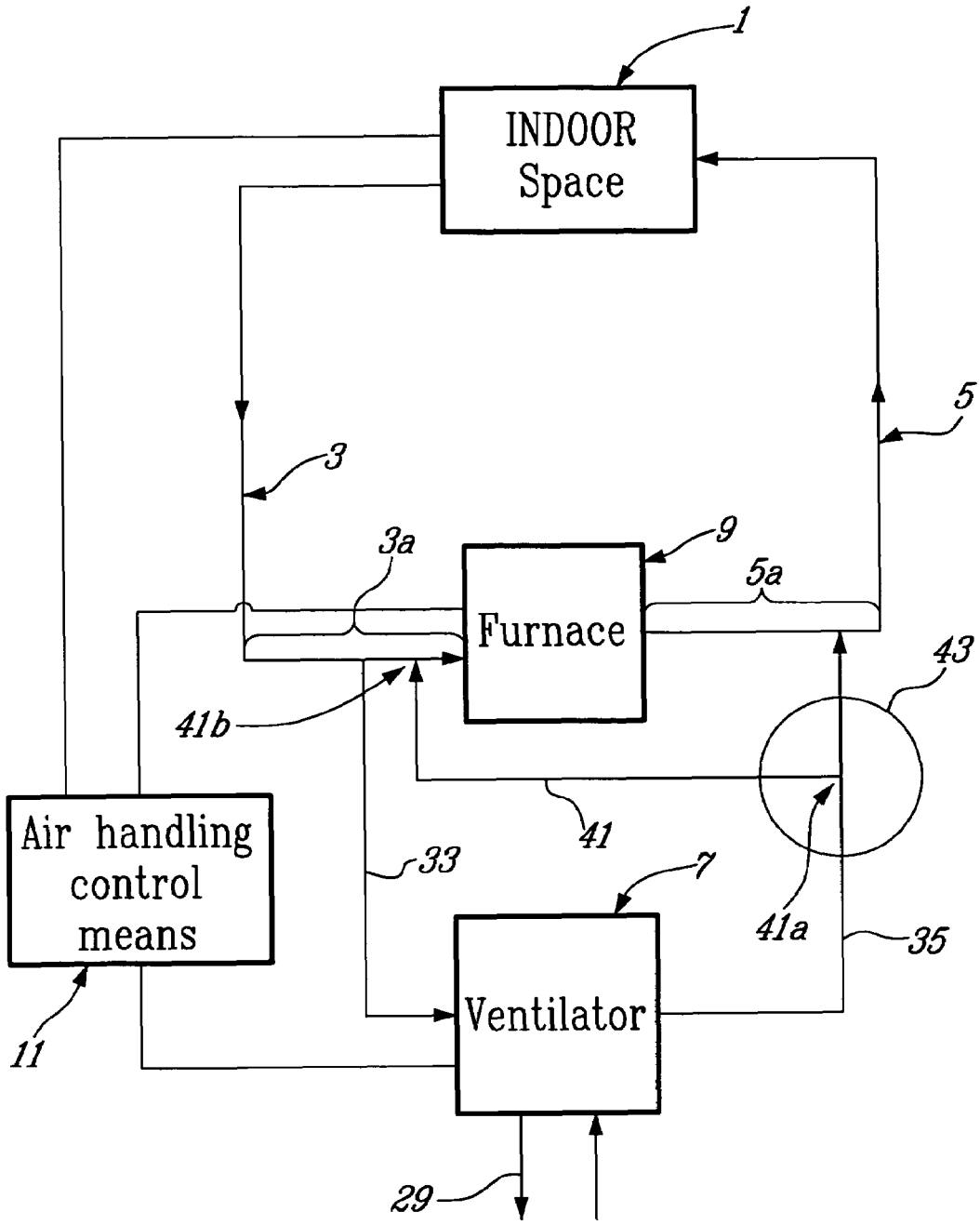
FIG. 1 is a schematic representation of an example embodiment of an air handling system in accordance with the present invention.

FIG. 1 illustrates in schematic fashion an air handling system for an indoor space 1 in accordance with the present invention.

The air handling system as shown in FIG. 1 is associated with an air duct system which has an air supply or input portion 3 and an air return or output portion 5.

It is to be understood that the input and output portions 3 and 5 may as desired or needed comprise a plurality of duct members or elements which run to and from one or more indoor spaces. In the case of a plurality of indoor spaces, for example, a plurality of sub-duct members may on the one hand be each separately coupled to a respective indoor air space and on the other be coupled to or terminate in a respective single duct leading to or from an air treatment component as the case may be. Furthermore, the air duct system may interconnect or couple one or more indoor spaces with one or more air treatment components and one or more air ventilator components; at least one, but preferably all, of the air ventilator components present, being interconnected with the input and output duct work of the air duct system in a fashion reflecting the discussion which follows, i.e. reflecting a reflux air path and associated air dampers.

Thus for illustration purposes only, the air supply or input portion 3 and the air return or output portion 5 are each shown in FIG. 1 as being a single (duct) line leading from or to the indoor space or environment 1. The duct system elements are interconnected to various members of the air handling system by any suitable (i.e. known) interconnection mechanisms.

The air handling system shown in FIG. 1 comprises two basic air handling units, namely a forced fresh air ventilator component 7 and a forced air treatment component 9 in the form of a forced air furnace component. The system is provided with (known types of) control means 11 electrically coupled to the furnace blower means and the ventilation air blower means for independently electrically actuating same (the control means may for example be located somewhere in indoor space 1).

The air supply or input portion 3 of the air duct system as illustrated includes an input indoor air duct, generally designated by the reference numeral 3*a*, (i.e. air path element) which is coupled at one end to the furnace component 9 (i.e. coupled to the furnace air inlet). On the upstream side of the furnace component the air return or output portion 5 of the air duct system has an output heated air duct, generally designated by the reference numeral 5*a*, (i.e. air path element) which is also coupled at one end thereof to the furnace component 9 (i.e. coupled to the furnace air outlet). The other respective ends of the input indoor air duct 3*a* and the heated air output duct 5*a* are respectively connected or coupled to the indoor air space 1 (as shown).

Figure 2:
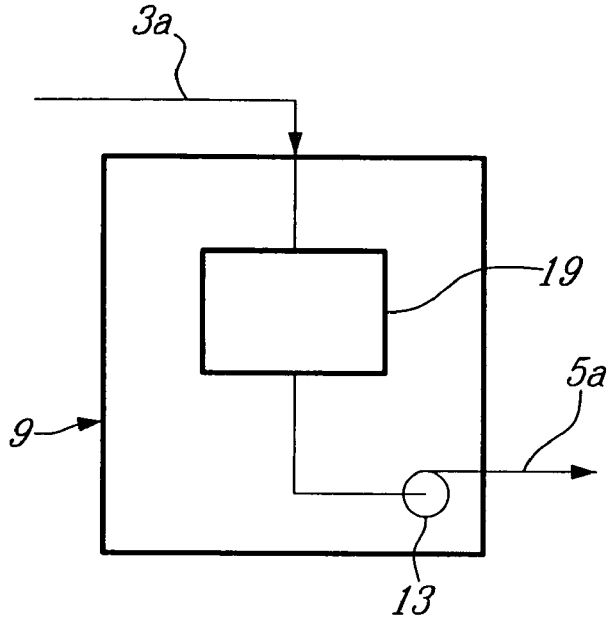
FIG. 2 is a schematic representation of an example forced air furnace component for the air handling system shown in FIG. 1.

As shown in FIG. 2, the forced air furnace component 9 as illustrated is associated with an internal furnace air blower means which comprises a single air blower member 13 having an electrically energizable blower motor element (not shown).

Figure 3:
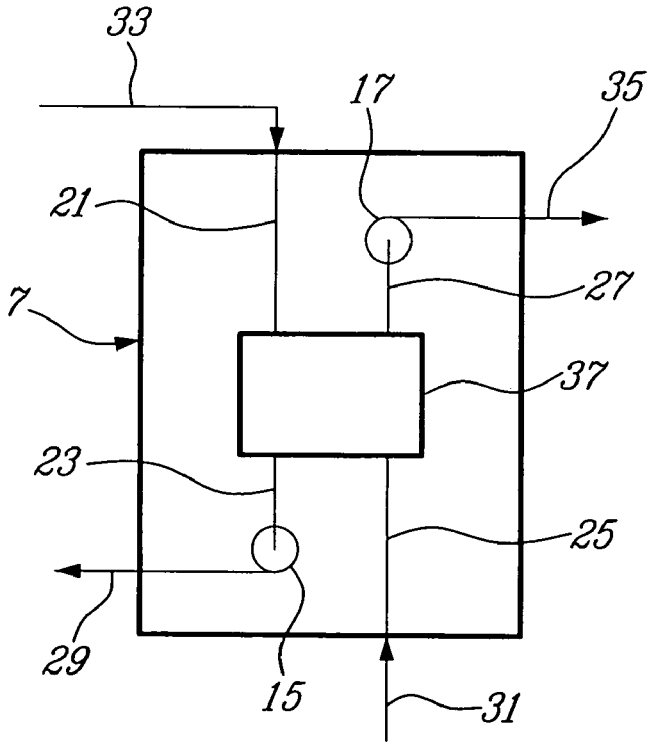
FIG. 3 is a schematic representation of an example forced air ventilator component for the air handling system shown in FIG. 1.

As shown in FIG. 3, the illustrated forced fresh air ventilator component 7 is associated with an internal ventilation air blower means which comprises a stale air blower member 15 and a fresh air blower member 17, each having an electrically energizable blower motor element (not shown); on the other hand, if desired and appropriately configured the internal ventilation air blower means could of course only comprise a single common blower motor element forming part of each blower member.

It is of course to be understood that any blower members associated with the forced fresh air ventilator component 7 and/or the forced air furnace component 9 could if so desired be coupled to the duct system externally of the ventilator and/or furnace components. The furnace and ventilator air blower members may each take any desired (i.e. known) form keeping in mind their purpose, namely to urge air through the respective air path means, in response to a (known) control means.

The illustrated furnace component in FIG. 2, also comprises a heating core element 19. As may be appreciated the furnace blower member 13 is coupled to the heating core element 19 such that the when the furnace component 9 is in an active heating mode the furnace air blower member 13 will induce or force a flow of return indoor air through the input indoor air duct 3*a* (i.e. to the furnace air inlet) into the heating core element 19, through the heating core element 19 and blower member 13 and finally to the output heated air duct 5*a* (i.e. out the furnace heated air outlet). The heating core element 19 may take any (known) form, e.g. an oil burner core, a natural gas burner core, etc.

Turning back to FIG. 1, the illustrated forced fresh air ventilator component 7 may be configured in any suitable or desired (i.e. known) manner for discharging stale air from the indoor space (e.g. at least a portion of stale air entering the input indoor air duct 3*a*) to an outdoor environment and for replacing the discharged air with make-up air (i.e. fresh air) from the outdoor environment.

Turning again to FIG. 3, the fresh air ventilator component may comprise a stale air input means 21 (i.e. stale air inlet element) coupled to a stale air output means 23 (i.e. stale air outlet element) and make-up air input means 25 (i.e. fresh air inlet element) coupled to a return air output means 27 (i.e. fresh air outlet element). The fresh air ventilator component 7 may for example take a form as shown in above mentioned U.S. Pat. Nos. 5,193,630, 5,771,707, 6,209,622, 6,257,317, 6,289,974 as well as in U.S. patent application Ser. No. 10/158,492 published under no. 20030013407. The ventilator component 7 may be a heat recovery ventilator which discharges the stale or exhaust air to an outdoor environment (via an exhaust air duct element 29) and replaces the discharged stale air with make-up air from the outdoor environment (via fresh air duct element 31); the heat recovery ventilator including means to exchange heat between the discharged circulation air and the make-up air.

Referring to FIGS. 1 and 3, the fresh air ventilator component 7 is coupled to the input indoor air duct 3*a* and the output heated air duct 5*a* respectively by a stale air duct 33 and a primary output (e.g. fresh) air duct 35. Thus as may be seen the stale air duct 33 (i.e. air path element) is coupled to the stale air input means 21 and to the input indoor air duct 3*a*; the return air duct 35 (i.e. air path element) couples the return air output means 27 to said treated (e.g. heated) air duct 5*a*.

Still referring to FIGS. 1 and 3, for ventilation purposes the blower member 15 may be configured to force stale air directly to the outside environment whereas the other blower member 17 may be configured for forcing out-side make-up air (i.e. fresh air) directly to the heated air duct 5*a*. Advantageously, however, as mentioned above, the fresh air ventilator component may comprise some means of heat exchange between exhaust stale air and make-up fresh air. Thus, the illustrated forced fresh air ventilator component is shown as comprising a heat exchange core element 37. The heat exchange core element 37 may be of any suitable (known) configuration which is able to facilitate sensible heat transfer and if so desired the transfer of humidity (i.e. water vapor) as well; in other words the heat exchange core element may be able to provide for transfer of latent heat as well as sensible heat (i.e. total heat); please see for example the core elements described in the above mentioned U.S. patent documents.

As may be appreciated the stale blower member 15 is coupled to the heat exchange core element 37 such that the when the ventilator component is in an active ventilation mode, the stale air blower member 15 will induce or force a flow of return indoor air from the stale air duct 33 through the ventilator stale air inlet into the heat exchange core element, through the heat exchange core element and stale air blower member 15 and finally out exhaust air duct element 29 to the outside environment. On the other hand, the fresh air blower member 17 is coupled to the heat exchange core element 37 such that the when the ventilator component is in an active ventilation mode, the fresh air blower member 17 will induce or force a flow of fresh outdoor air from the outside environment through the fresh air duct element 31 into the heat exchange core element 37, through the heat exchange core element and fresh air blower member 17 and finally out the ventilator fresh air outlet into the return air duct 35.

Turning back to FIG. 1, the illustrated air handling system, in accordance with the present invention, additionally comprises a further secondary output (e.g. fresh) air duct element 41; the further secondary output (e.g. fresh) air duct element 41 has a first end designated generally by the reference number 41*a* and a second end designated generally by the reference number 41*b*. If appropriately configured the further secondary output (e.g. fresh) air duct element 41 may provide the desired or necessary air to the front end of the furnace ductwork without more elements. However, as shown in FIG. 1 the portion of the ductwork encircled by the circle designated by the reference numeral 43 may further comprise a first air flow control means and a second air flow control means as shall be discussed below with respect to FIGS. 4 to 7, i.e. the encircled portion of FIG. 1 reflects a schematic view of a manifold component.

The purpose of the further secondary output (e.g. fresh) air duct element 41 is to provide an air path for fresh air to the input indoor air duct element 3*a* which feeds air to the furnace component. Thus the further secondary output (e.g. fresh) air duct element 41, in any (known) manner, is coupled to the primary output (e.g. fresh) air duct 35 (i.e. at the first end 41*a*) and to the input indoor air duct element 3*a* (i.e. at the second end 41*b*).

Referring to FIGS. 4 to 7 the same reference numerals will be used to designate common elements. FIGS. 4 to 7 generally illustrate in schematic fashion example embodiments of manifold components in accordance with the present invention. The example manifold components have an air inlet indicated generally by the reference number 44. The manifold components have a first air outlet indicated generally by the reference number 44*a* and a second air outlet indicated generally by the reference number 44*b*. The first air flow control means, inter alia, comprises a first damper element 50 and the second air flow control means, inter alia, comprises a second damper element 52. Each of the damper elements 50 and 52 has a respective broad side face 54 and 55 against which air flow through respective ductwork may impinge, i.e. the damper elements 50 and 52 have a projected area exposed to airflow for air flow blocking purposes. A damper element may also (as discussed below) be associated with a damper bias member. A damper bias member may take on any desired or necessary form including but not limited to springs, weights, etc. as well as combinations thereof; the biasing force exerted by a bias member is of course to be calibrated keeping in mind the purpose of the damper element with which it is associated.

As may be seen from FIG. 1 as well as FIGS. 4 to 7 the first damper element 50 is associated with the primary output (e.g. fresh) air duct element 35. Similarly, the second damper element 52 is associated with the further secondary output (e.g. fresh) air duct element 41. Such associations shall be discussed in more detail below. However, as seen in FIGS. 4 to 7, the primary output (e.g. fresh) air duct element 35 is coupled to the further secondary output (e.g. fresh) air duct element 41 and the heated air duct element 5*a* so that an end portion of the primary output (e.g. fresh) air duct element 35 defines an upstream duct member 35*a*. The upstream duct member 35*a*, as seen, is between the further secondary output (e.g. fresh) air duct element 41 and the heated air duct element 5*a*, i.e. the upstream duct member 35*a* defines an upstream (duct) connection.

Referring to FIGS. 4 to 7, as mentioned above the first and second damper elements 50 and 52 are independently displaceable between respective blocking and non-blocking configurations.

The first damper element 50 is displaceable independently of the second damper element 52 between a blocking configuration and a non-blocking configuration. When in the blocking configuration, the first damper element 50 is disposed to close or choke off the primary output (e.g. fresh) air duct element 35 to air flow (i.e. there through). When in the non-blocking configuration, the first damper element 50 is disposed such that air is able to circulate through the primary output (e.g. fresh) air duct element 35.

The second damper element 52 is also displaceable independently of the first damper element 50 between a blocking configuration and a non-blocking configuration. When in the blocking configuration, the second damper element 52 is disposed to close off the further secondary output (e.g. fresh air duct element 41 to air flow. When in the non-blocking configuration, the second damper element 52 is disposed such that air is able to circulate through the further secondary output (e.g. fresh air duct element 41.

Figure 4:
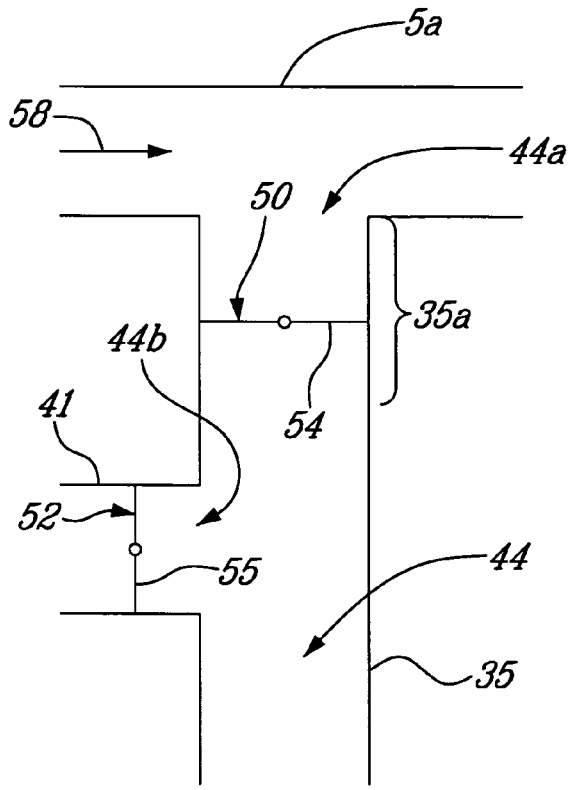
FIG. 4 is an enlarged schematic representation of the encircled portion of the secondary duct system as seen in FIG. 1 with both first and second damper elements in a blocking configuration.

FIG. 4 shows both of the damper elements in a blocking configuration, i.e. a configuration available for a non-operational mode for the system or for a furnace operation only mode. For a furnace only operation mode air flows in the direction of arrow 58 from the furnace component.

Figure 5:
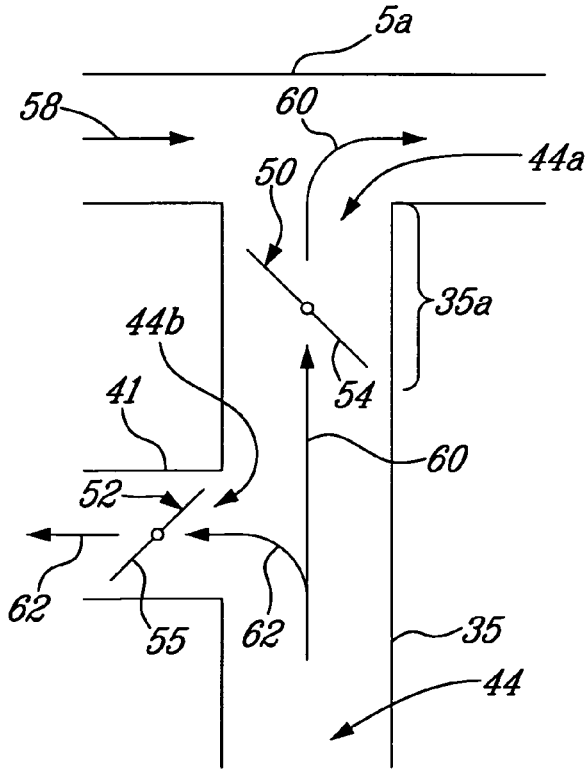
FIG. 5 is an enlarged schematic representation of the encircled portion of the secondary duct system as seen in FIG. 1 with both first and second damper elements in a non-blocking configuration.

FIG. 5 shows both of the damper elements 50 and 52 in a non-blocking configuration, i.e. a configuration available for a combination mode operation for the system wherein both the furnace and air ventilator components are simultaneously operating. For this mode of operation the air flows in three directions as indicated by the arrows 58, 60 and 62, namely from the furnace component 9 (arrow 58), from the ventilator component 7 (arrows 60 and 62) as well as to the air input duct element 3*a* (arrow 62).

Figure 6:
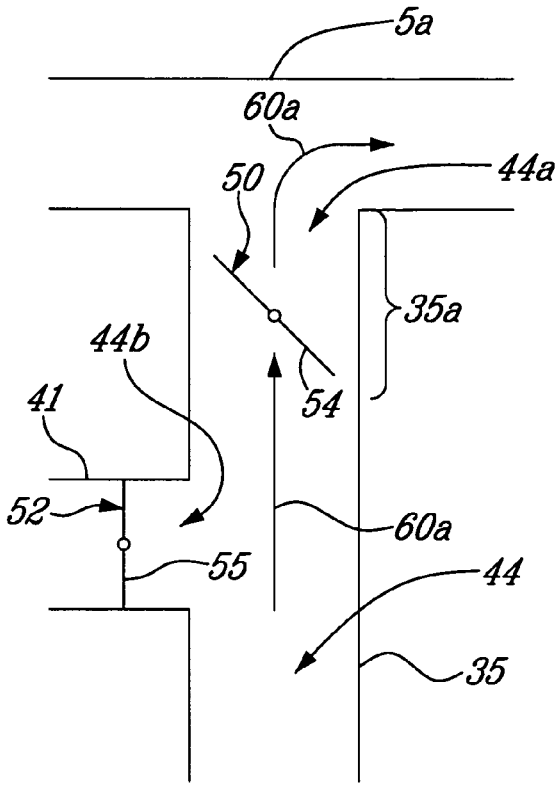
FIG. 6 is an enlarged schematic representation of the encircled portion of the secondary duct system as seen in FIG. 1 with the first damper element in a non-blocking configuration and the second damper element in a blocking configuration.

FIG. 6 shows the first damper element 50 in a non-blocking configuration and the second damper 52 in a blocking configuration, i.e. a configuration available for a ventilation mode only operation for the system. For a ventilator only operation mode, air flows in the direction of arrow 60*a* from the ventilator component.

As may be seen from FIGS. 4 to 7 the primary output (e.g. fresh) air duct element 35 has an (outlet) opening 44*a* which communicates with the interior of the output heated air duct element 5*a*. Similarly the further secondary output (e.g. fresh air duct element 41 has an (inlet) opening 44*b* which communicates with the interior of the primary output (e.g. fresh) air duct element 35.

Figure 7:
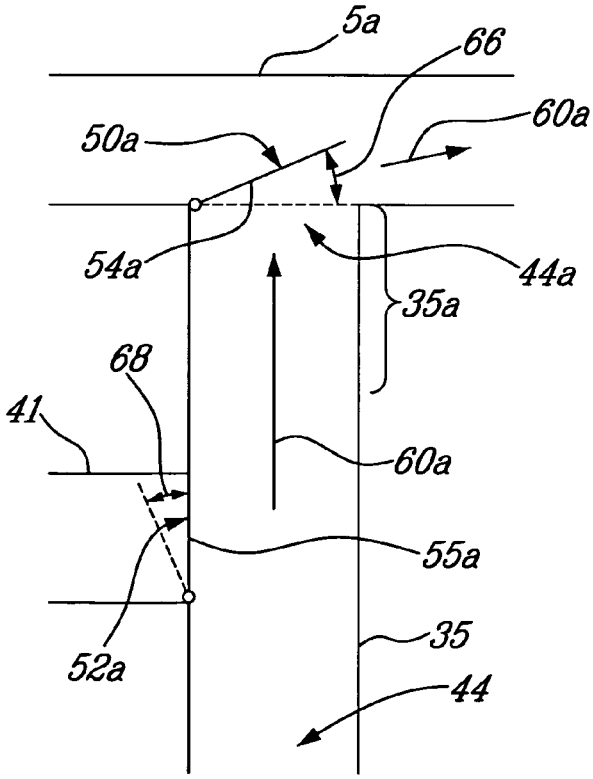
FIG. 7 is an enlarged schematic representation of the encircled portion of the secondary duct system as seen in FIG. 1 showing an alternate disposition of the first and second damper elements wherein the full lines show the first damper element in a non-blocking configuration and the second damper element in a blocking configuration.

The FIG. 7 shows an alternate arrangement for the first and second dampers 50*a* and 52*a*. The damper elements 50*a* and 52*a* shown in FIG. 7 are hinged at a side edge thereof. As shown the first damper element 50*a* is essentially disposed in the outlet opening of the return air duct element 5*a* and the second damper element 52*a* is disposed in the inlet opening of the reflux air duct element 41. Furthermore, whereas FIGS. 4 to 6 show the damper elements 50 and 52 as having a butterfly type construction the damper elements 50*a* and 52*a* as shown in FIG. 7 have a door-like configuration given that they are each pivotable at a side edge thereof between positions designated by the direction of the arrows 66 and 68, i.e. between the solid and dotted line representations of the damper elements 50*a* and 52*a*. The solid line representations of the damper elements 50*a* and 52*a* shows their relative configuration for ventilation mode operation (i.e. for ventilation operation only of the air handling system), namely the first damper element 50*a* being in a non-blocking configuration and the second damper element 52*a* being in a blocking configuration with air flow as designated by arrow 60*a*.

Any damper elements or members are of course so sized and shaped that the broad side face 54 or 54*a* and 55 or 55*a* of the damper elements can block off an air duct so that air flow is inhibited from flowing through a duct. Thus, for example, in FIG. 7 for the ventilation mode operation the broad side face 55*a* of damper element 52*a* blocks off the inlet opening of the reflux duct element 41. As mentioned the damper elements may, if desired, be associated with respective damper biasing members.

In the case of damper elements shown in FIG. 7, a spring bias member, for example, may be provided (e.g. at the hinged edge) in any suitable (known) manner (see for example FIG. 14*a*) such that the spring bias member directly or indirectly engages the damper element for biasing the damper element in a closed or blocking configuration. The damper elements are in any event disposed so that they can be rotatably displaced against the biasing action of a respective spring bias member in the direction of the arrows 66 and 68 between the non-blocking configuration and the closed or blocking configuration; in the latter configuration the air opening will be blocked off by the appropriately sized side of the damper elements 50*a* and 55*a*.

As mentioned, a broad side face 54, 54*a*, 55 and 55*a* of a respective damper member may be biased so as to be disposed in the blocking configuration transverse to air flow through the associated ductwork. In accordance with an embodiment of the present invention a damper element 50 (or 50*a*) and/or 52 (or 52*a*) may be displaced between the blocking configuration and the non-blocking configuration by means of internal air pressure brought to bear against the damper elements (e.g. against a broad side face of the damper element), the air pressure acting against the biasing action of the respective damper bias members. The necessary air pressure is induced by the ventilation air blower means when the ventilator component is activated or by the combined air pressure effect of the ventilation air blower means and the furnace blower means when the system is operating in combination mode. Thus the biasing members of the first and second damper elements are each respectively calibrated such that during ventilation mode (only) the first damper element 50 (or 50*a*) is in open position and the second damper element 52 (or 52*a*) remains in closed position whereas during combination mode operation the first and second damper elements are both in open position; in the latter case the first damper element is set to be in a somewhat more closed position relative to its open position with respect to its ventilation only open state, i.e. this is to account for air flowing past the second damper element back to the front end of the furnace duct work. Thus for example, in ventilation only mode, the pressure generated by the ventilation blower means is sufficient to overcome the bias force of the first biasing member associated with the first damper element but is insufficient to overcome the bias force of the second biasing member associated with the second damper element since this second biasing member is calibrated to keep the second damper element closed at the ventilation (only) air pressure.

In accordance with an alternate embodiment of the present invention a first and/or second damper element may be displaced between the blocking configuration and the non-blocking configuration by means of a motor element connected to the damper element in any suitable (known) manner. The motor element may be used without a damper bias member, however, if desired or necessary a damper bias member may also exploited, i.e. in the latter case, while the spring member biases the damper element in a blocking configuration, the motor may be used to displace the damper element to the non-blocking configuration.

The motor may for example be connected to the damper element or member in a manner analogous to the connection system as shown in U.S. Pat. No. 5,193,610 such that electrical activation and deactivation of the motor will thus cause the damper element or member to be displaced between the blocking and non-blocking configurations. Any suitable motor (such as for example a synchronous motor as made by Hansen Manufacturing Company, Inc.) may for example be used for this purpose.

Any other suitable damper mechanism may of course be used, keeping in mind that the purpose of the first and second damper elements is to block off or leave unobstructed the appropriate secondary air path for the ventilation cycle, the heating cycle or the combination cycle, while leaving the main air paths unobstructed.

Referring to FIG. 8, is a schematic illustration of an air handling system in accordance with the present invention wherein the various components and elements are shown in more detail. The system has a forced air furnace component 70 and a forced fresh air ventilator component 72. The ventilator component 72 may take the form of a ventilator as shown for example in U.S. patent application Ser. No. 10/158,492 published under no. 20030013407. As may be seen the system has an input air duct element 74, an output air duct element 76, a stale air duct element 78, a return air duct element 80 and a reflux air duct element 82. The input air duct element 74 is connected to the interior spaces (i.e. rooms) of a house by sub-duct elements (not shown) in known manner. The output air duct element 76 is likewise connected to the interior spaces (i.e. rooms) of the house by sub-duct elements (not shown) in known manner. The stale air duct element 78 at one end is coupled to the input air duct 74 upstream of the furnace component 70; the stale air duct element 78 is connected at its other end to the stale air input 84 of the ventilator component 72. The stale air output 86 and the fresh or make-up air input 88 of the ventilator 72 are respective coupled to duct elements (not shown) which are in air communication with the outside environment for the discharge or exhausting of stale air to the outside environment and the intake of fresh air from the outside environment.

Figure 10:
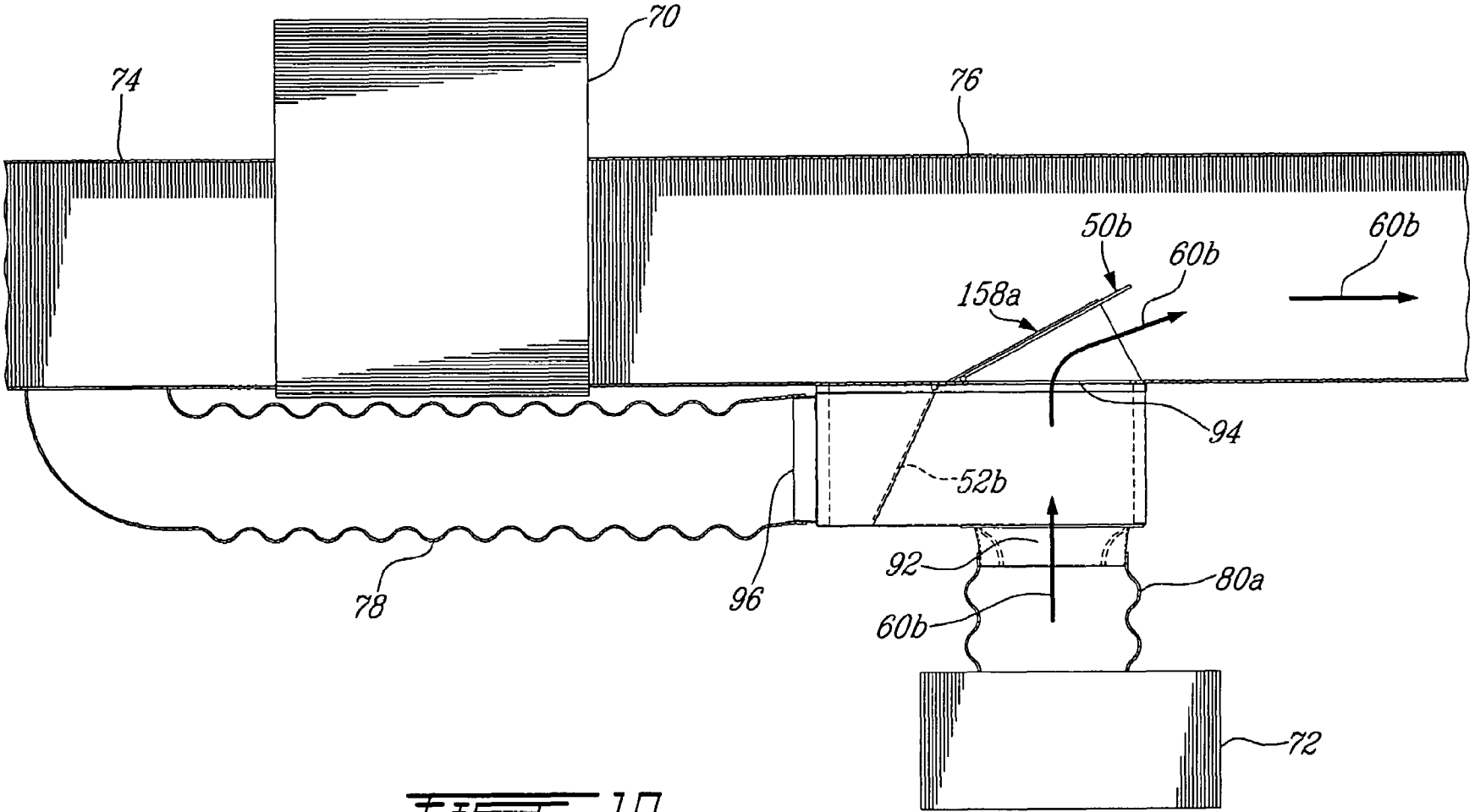
FIG. 10 is a schematic cross-sectional view from above of the air handling system as shown in FIG. 8 wherein the ventilator component is on (i.e. activated) and the furnace component may be off (i.e. inactivated)
Figure 11:
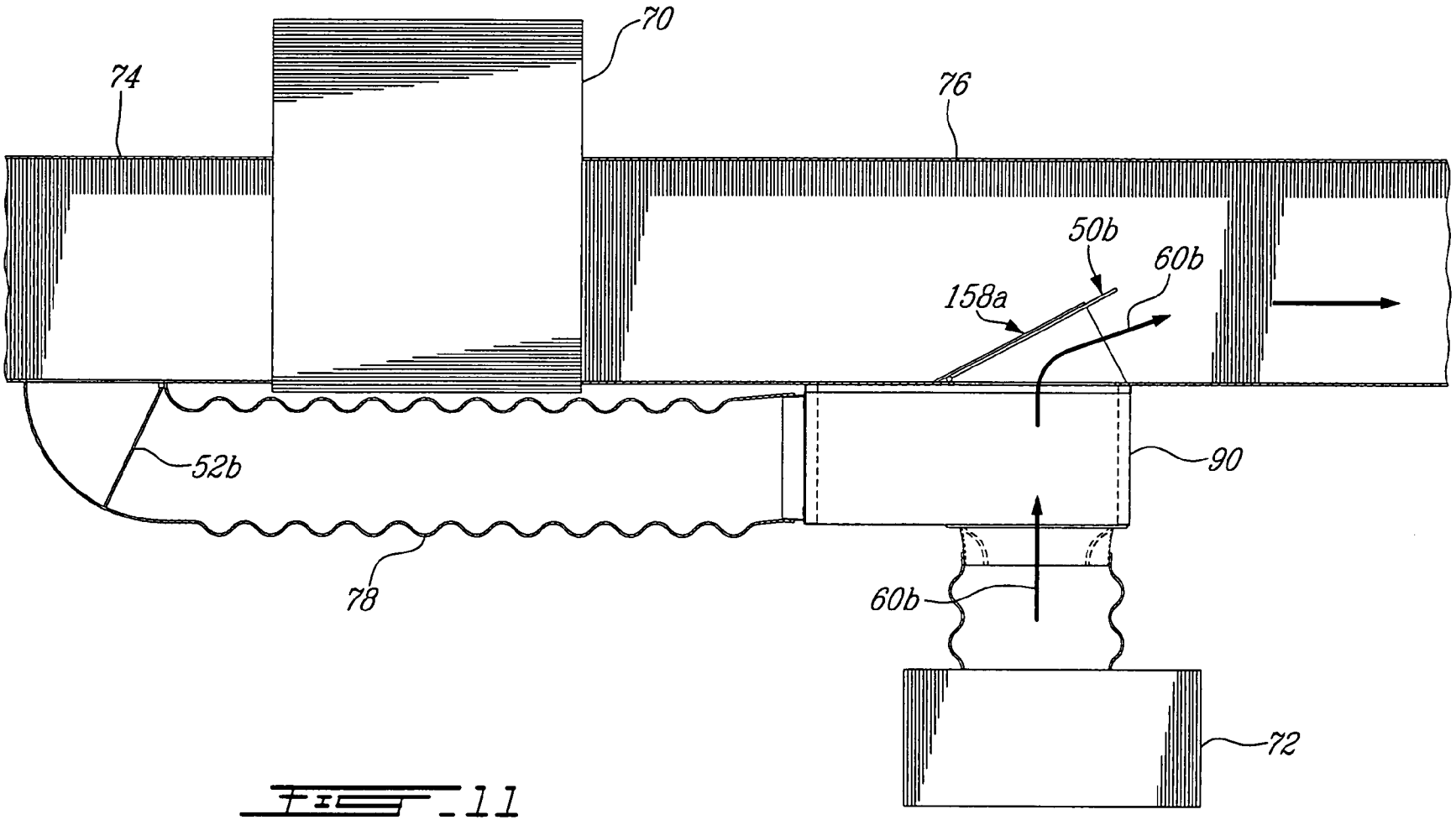
FIG. 11 is a schematic cross-sectional view from above of the air handling system as shown in FIG. 9 wherein the ventilator component is on (i.e. activated) and the furnace component may be off (i.e. inactivated) but wherein the second damper is disposed remote from the manifold member rather than being associated with the manifold member.
Figure 12:
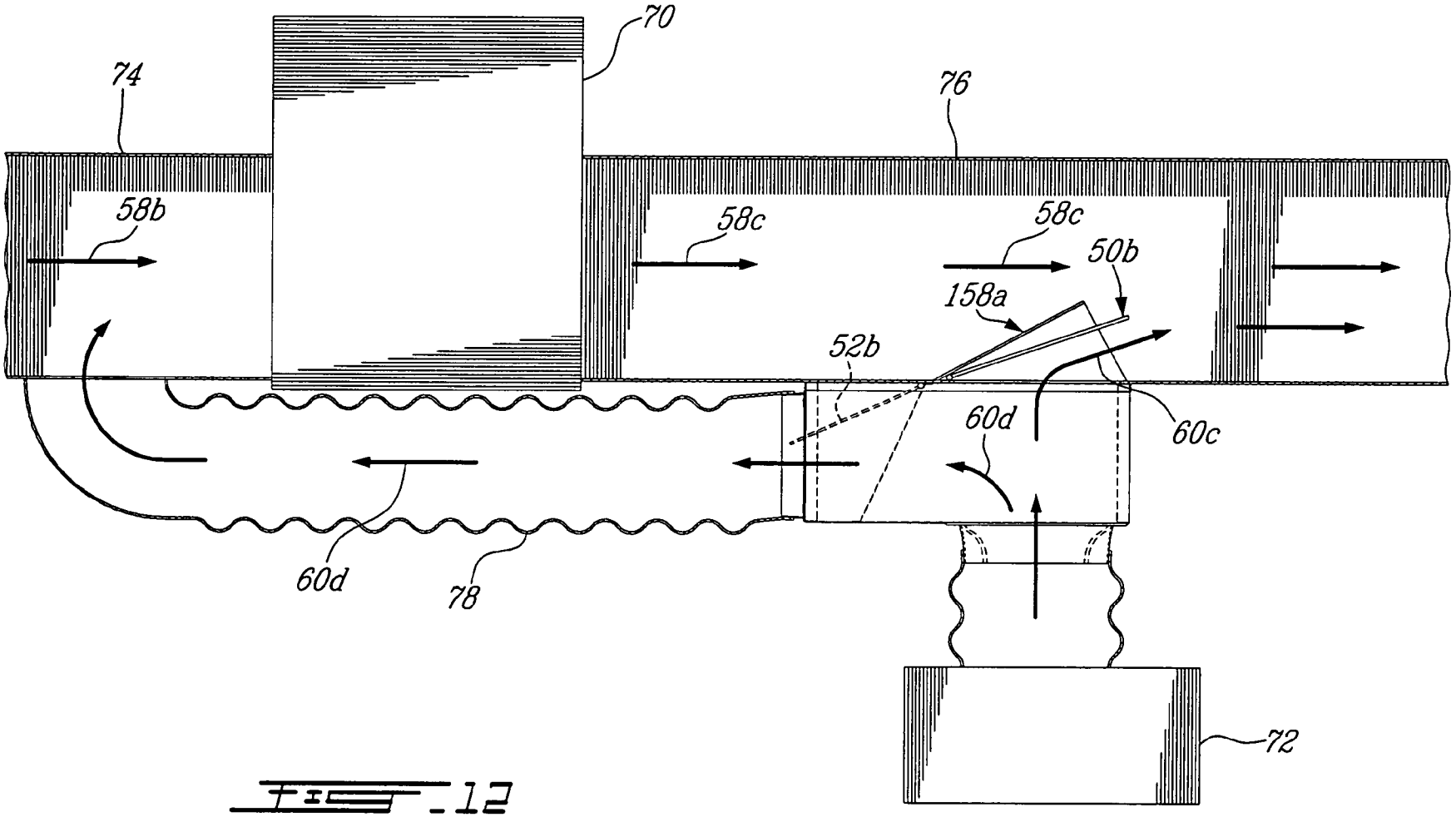
FIG. 12 is a schematic cross-sectional view from above of the air handling system as shown in FIG. 8 wherein the ventilator component is on (i.e. activated) and the furnace component may be on (i.e. activated)
Figure 13C:
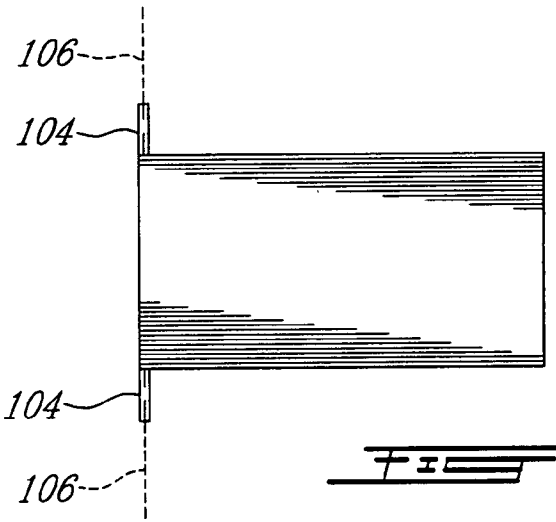
Figure 13D:
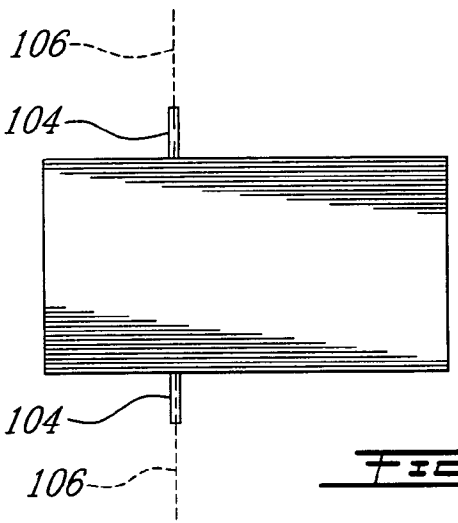
Figure 13A:
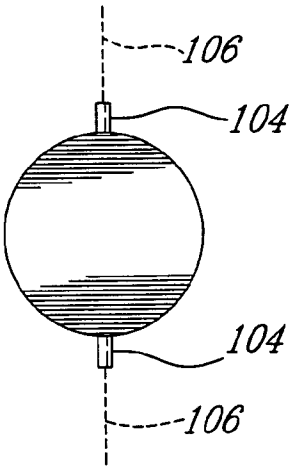
Figure 13B:
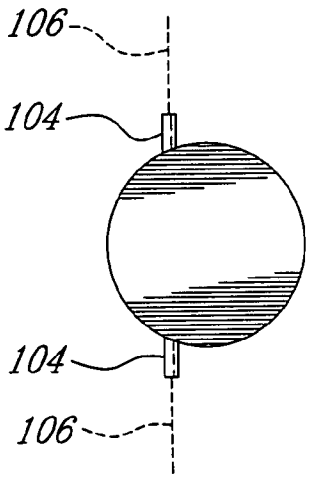

Referring to FIGS. 10 to 12 the return air duct element 80 has a duct member 80*a* and additionally has a manifold element 90. The manifold element 90 is fixed to a sidewall of the output duct element 76. The manifold element 90 has an air inlet 92 as well as first and second air outlets 94 and 96. The first air outlet 96 is flush with a corresponding opening in the sidewall of the output duct 76 so as to provide air flow access to the air output duct 76. The air inlet 92 is configured in any suitable (known) manner for being coupled to said duct member 80*a*; the first outlet 94 is configured in any suitable (known) manner for being coupled to said output or heated air duct 76 so as to define an upstream connection between the manifold element 90 and the heated or output air duct 76; and the second outlet 96 is configured in any suitable (known) manner for being coupled to said reflux air duct 78. The coupling mechanisms may take the form of outwardly projecting flanges, recessed snap fit engagement members, etc.; for example duct coupling mechanisms please see for example U.S. patent application Ser. No. 10/158,492 published under no. 20030013407.

The duct member 80*a* is coupled to the air inlet 92 of the manifold component or element 90 as well as to the return air output of the ventilator component 72. The reflux air duct 78 at one end is coupled to the second air outlet 96; the reflux air duct 78 is coupled at its other end to the input air duct 74 at a position between the furnace and the point of connection of the stale air duct element 78, i.e. the reflux duct element 82 is connected at a point downstream of the connection point for the stale air duct 78 but upstream of the furnace component 70.

Figure 9:
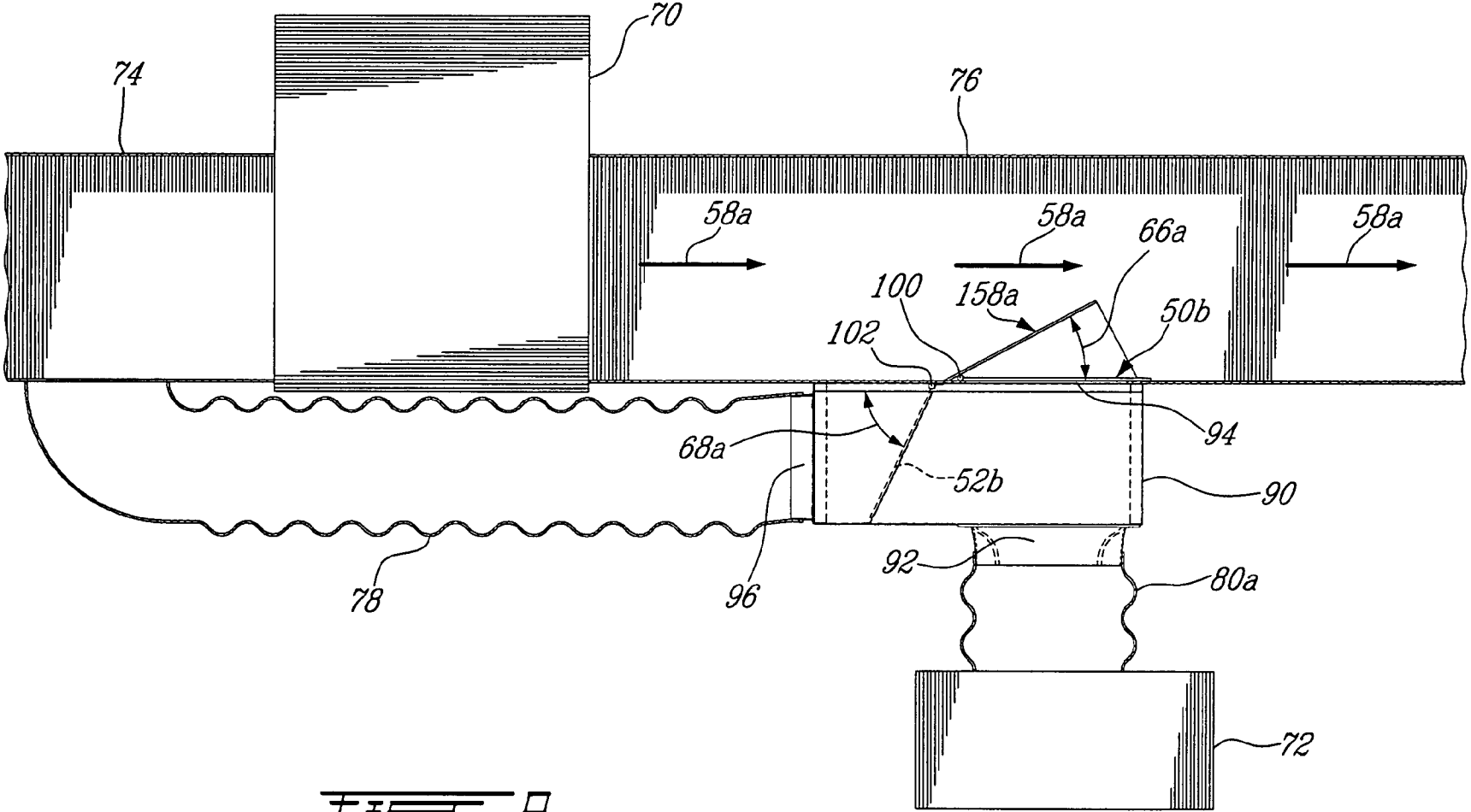
FIG. 9 is a schematic cross-sectional view from above of the air handling system as shown in FIG. 8 wherein the ventilator component is off (i.e. inactivated) and the furnace component may be on or off (i.e. inactivated or activated as desired)

The air handling system of FIG. 8, has a first damper element 50*b* and a second damper element 52*b*. The first damper element 52*b* is associated with the first air outlet 94 of the manifold element 90 whereas the second damper element 52*b* is indirectly associated with the second air outlet 96, i.e. the second damper element 52*b* is disposed within the manifold element 90 to one side of the second air outlet 96 of the manifold element 90. The first damper element 50*b* is of course shaped and configured relative to the first air outlet 94 so that it may block off air communication between the first air outlet 94 and the interior of the output duct element 76; thus FIG. 9 shows the first damper 50*b* in its air blocking configuration. Similarly the second damper element 52*b* is shaped and configured relative to the interior cross section of the manifold element 90 so that it make block off air communication between the interior of the manifold element 90 and the reflux duct element 78 via the second air outlet 96; thus FIG. 9 shows the second damper also in its air blocking configuration. The damper elements 50*b* and 52*b* are connected at respective side edges 100 and 102 thereof by side edge hinge elements which allow the damper elements 50*b* and 52*b* to pivot back and forth in the direction of the arrows 66*a* and 68*a*.

FIGS. 13*a-d* illustrate alternative damper forms for the first and second damper elements as described herein; the damper form used will of course be a function of the shape of the first outlet of the manifold element as well as the interior cross section of the manifold element; thus dampers can be of any shape (round, rectangular or other) and can hinge at different locations (by their extremities, by their centers or by any intermediate configuration). The damper elements of FIGS. 13*a-d* are provided with respective pivot pins 104 for engagement with pivot pin engagement elements (in known fashion) to provide the pivot action of the damper elements about axis 106, i.e. into and out of the plane defined by paper sheet of which the damper elements are illustrated.

The dampers may be maintained in a blocking (or even if so desired in a non-blocking) configuration by use of suitable biasing members which may act directly or indirectly on the dampers.

FIG. 14 illustrates an example air pressure displaceable damper structure for the first and second damper elements wherein biasing is provided by a gravity weight 110 placed to one side of the pivot axis; in this case the dampers and any weights are so disposed that the damper elements are maintained in a blocking configuration by their own weight and that of any added counterweight or gravity weight. The gravity weight is predetermined so that a predetermined air pressure on the downstream broad face or side of the damper element (flowing in the direction of arrow 112 will induce the damper to pivot as shown by the arrow 114 about axis 116. Counterweights may also be added to or can be directly embedded into the dampers to properly air flow rebalance a particular air handling system, to overcome differences between different mounting configurations (i.e. discrepancies between gravity effects on vertical versus horizontal installations).

FIG. 14*a* illustrates a first damper element 50*b* biased by a leaf spring 120 in a blocking configuration in the first outlet opening; again a predetermined air pressure air in the direction of the arrow 112*a* will urge the damper element 50*a* into a non-blocking configuration for the duration of the air pressure. A damper bias member may take other spring like forms such as for example a tension or compression spring. The biasing action of such spring bias members may be adjusted by moving the point of engagement or attachment to the damper element in relation to the pivot axis.

A damper element may be of a rigid material. Alternatively a damper element 125 as shown in FIG. 15 may be of a flexible material so as to have an inherent biasing characteristic such that when one edge 126 of the damper element 125 is fixed to a duct wall, a predetermined air pressure (in the direction of the arrow 128) will urge the damper to a non-blocking configuration (dotted outline) for the flow of air past the damper element 128 for the duration of the air pressure flow.

The first and second damper elements 50*b* and 52*b* may as mentioned above and shown for example in enlarged FIG. 16 have separate pivot or hinged side edges 100*a* and 102*a*.

Alternatively the damper elements 50*b* and 52*b* may as shown in FIG. 17 be pivotable about a common pivot axis member. FIG. 17 also illustrates a possible alternate biasing technique wherein a common flexible member 135 [e.g. spring or spring-like member (e.g. elastic)] links the first and second damper elements. This flexible member is configured so as to be able to exert sufficient force to maintain the two damper elements in their respective blocking configurations but under the influence of a predetermined air pressure in the direction of the arrows will allow the damper elements to be urged to a predetermined desired non-blocking configuration.

In any event the exact characteristics any of the biasing techniques mentioned herein may be determined empirically (i.e. by trial and error), keeping in mind the comments herein.

The air flow for the system shown in FIG. 8 will be discussed herein below on the basis that each of the damper elements has an associated biasing means as discussed herein such that the damper elements are displaceable from blocking configuration to a non-blocking configuration by air pressure generated by the ventilation blower means alone (positive air pressure) or by both the ventilation blower means and the furnace blower means operating simultaneously (positive and negative air pressure as the case may be).

Turning to FIG. 9, this figure shows the closed disposition of the damper elements 50*b* and 52*b* wherein the ventilator component is off (i.e. inactivated) and the furnace component may be on or off (i.e. inactivated or activated as desired). When the furnace is off (i.e. the furnace blower is inactive) there is no air flow from the furnace in the direction of the arrows 58*a*. However, when the furnace air blower alone is activated, the furnace air blower induces the circulation of indoor air from the indoor space through the air supply air path component to the furnace which heats the indoor circulation air, and through the air return air path component to the indoor space (i.e. in the direction of the arrows 58*a*. Since the ventilation blower is inactive there is insufficient air pressure against either damper elements to displace them to an open configuration (i.e. non-blocking state).

Turning to FIG. 10 this figure shows the disposition of the damper elements 50*b* and 52*b* wherein the ventilator component is on (i.e. activated) and the furnace component is off (i.e. inactivated); there is only air flow from the ventilator in the direction of the arrows 60*b*. FIG. 11 shows the same air flow as for FIG. 10 but wherein the second damper 52*b* is disposed remote from the manifold element 90 (i.e. in the reflux duct element 78) rather than being associated with the manifold element 90. In either case there is no air flow through the reflux air duct 78 back to the indoor air input air duct. More particularly, the first biasing means of the first damper is configured such that, when the ventilation air blower means alone is activated, the ventilation air blower means generates an air pressure applied against the first damper element 50*a* so as to overcome said first biasing means such that the first damper is displaced from the blocking configuration (see FIG. 9) toward said non-blocking configuration and whereby the ventilation air blower means induces the circulation of air through the indoor air supply air path duct and the stale air duct element for delivery to the fresh air (e.g. with at least some heat recovery) ventilation component wherein at least a portion of the delivered air is induced to discharge into the outdoor environment and make-up air from the outdoor environment is induced to flow into the fresh air (e.g. with at least some heat recovery) ventilation component wherein the make-up air and any remaining delivered air is induced to circulate through the return air discharge duct element and through the treated air return air path duct to the indoor space. On the other hand, the pressure generated by the ventilation blower means is insufficient to overcome the bias force of the second biasing member associated with the second damper element since this second biasing member is calibrated to keep the second damper element closed at the ventilation (only) air pressure.

Turning to FIG. 12 this figure shows the disposition of the damper elements 50*b* and 52*b* wherein the ventilator component is on (i.e. activated) and the furnace component is on (i.e. activated); there is air flow from the ventilator in the direction of the arrows 60*c* and 60*d*, into the reflux duct in the direction of the arrows 60*d*, into the furnace in the direction of the arrows 58*b* and from the furnace in the direction of the arrows 58*c*. The first and second air flow control means (i.e. dampers, etc.) are each configured in any suitable or desired manner such that, when a furnace air blower means associated with said forced air furnace component 70 and a ventilation air blower means associated with said forced fresh air ventilator component 72 are both activated (i.e. simultaneously activated), the first damper element 50*b* and the second damper element 52*b* are each in a non-blocking configuration. In other words, sufficient air pressure is generated in the system so that both air flow control means are in open mode but keeping in mind that the first air flow control means will be closed somewhat in relation to its open position during ventilation only mode to account for air flow back to the furnace air input side of the duct work (see the open position of damper 50*b* in FIGS. 10 and 12).

As illustrated in FIG. 12, when both the furnace air blower and the ventilation air blower means are activated, indoor air is induced to circulate from the indoor space through the air supply air path component to the furnace which heats the indoor circulation air, and through the air return air path component to the indoor space and air is induced to circulate through the stale air duct element for delivery to the fresh air (e.g. with at least some heat recovery) ventilation component wherein at least a portion of the delivered air is induced to discharge into the outdoor environment and make-up air from the outdoor environment is induced to flow into the fresh air (e.g. with at least some heat recovery) ventilation component wherein the make-up air and any remaining delivered air is induced to circulate through the return air discharge duct into the heated air duct element 76 as well as the reflux duct element 78.

In addition to or as an alternative to biasing and air pressure activation, different types of actuator mechanisms can be used with respect to the first and second damper elements. Even if the previously described air pressure activated system is pressure actuated for opening and spring loaded for closure & failsafe mode, actuation of dampers can be achieved by other kind of actuators mechanisms. Electrical motors, solenoids or other type of valves can be employed The air handling system may as mentioned above, if desired, includes appropriate temperature sensor(s), electric wiring, control mechanisms for controlling the various motors for the ventilation and defrost cycles, etc. (none of which is shown in the figures but which can be provided in any suitable or desired conventional manner). These mechanism may example include programmable computer type controls. A heating cycle for example may be triggered by a thermistor or thermostat connected to a timer; a ventilation cycle for example may be triggered by a timer.

Turning to FIGS. 18 and 19 tests were conducted on the air handling configurations shown in these figures in order to take steady state pressure and air flow readings as set out in the figures.

FIG. 18 illustrates of an air handling system as set forth in FIG. 8 but without the reflux air duct element which was subject to testing for the results in table 1. For table 1 and FIG. 18 the abbreviations have the following meaning:

| | |
|---|---|
| $P_R$ | Return Pressure |
| $Q_{FR}$ | Return flow |
| $P_F$ | Furnace Pressure |
| $Q_F$ | Furnace flow |
| $Q_{CR}$ | Return Flow to air treatment |
| $Q_{CD}$ | Distribution flow from air treatment |
| $P_D$ | Distribution pressure |
| $Q_{FD}$ | Distribution flow |

The results of the tests for the system configuration shown in FIG. 18 are set out in table 1 which follows:

TABLE 1

| | $P_R$ (in. w. g.) | $Q_{FR}$ ($ft^3$/min) | $Q_F$ ($ft^3$/min) | $P_F$ (in. w. g.) | $Q_{CD}$ ($ft^3$/min) | $Q_{CR}$ ($ft^3$/min) | $P_D$ (in. w. g.) | $Q_{FD}$ ($ft^3$/min) |
|---|---|---|---|---|---|---|---|---|
| Furnace Only | 0.1 | 866 | 866 | 0.4 | 0 | 0 | 0.3 | 866 |
| Furnace + Air treatment unit | 0.13 | 1047 | 792 | 0.63 | 255 | 255 | 0.5 | 1047 |
| Air treatment unit Only | 0 | 0 | 0 | 0 | 298 | 298 | 0 | 0 |

FIG. 19 illustrates an air handling system as set forth in FIG. 8 which was subject to testing for the results in table 2. The air handling system of FIG. 19 thus has a reflux air duct element as well as first and second damper elements each damper element having an associated biasing means as discussed herein with respect to FIG. 20 such that the damper elements are displaceable from blocking configuration to a non-blocking configuration by air pressure generated by the ventilation blower means alone (positive air pressure) or by both the ventilation blower means and the furnace blower means operating simultaneously (positive and negative air pressure as the case may be).

Referring to FIG. 20, the illustrated manifold element has a first damper element 150 and a second damper element 152. These damper elements are hinged or pivotable about respective pivot axii 154 and 156 which are disposed perpendicular to the surface of the drawing sheet on which the manifold element is shown. In closed configuration the damper elements abut or engage stopper elements 158 or 160 as the case may be. With respect to the first damper element an open configuration stopper element 158*a* is also provided so as to limit the extent to which this damper may pivot in open configuration; this same stopper is shown in FIGS. 9 to 12 as well as in FIGS. 16 and 17. The stopper element 158*a* may take the form of a grill or flat plate; it may also a tab member such as designated by the reference numeral 158*b*. In open configuration air may flow past the damper element 150 as shown by the arrow 159. Each of the damper elements are shown as being associated with a respective bias spring 162 or 164 as the case may be. The bias springs 162 and 164 are shown as being attached to a common anchor point (e.g. to a side wall of the manifold element); if so desired separate anchor points could of course be used instead. The design of the springs 158 and 160 is done to optimize the airflow returning by the by-pass or reflux path when the furnace and the ventilation device are both on.

For table 2 and FIG. 19 the abbreviations the have the following meaning:

| | |
|---|---|
| $P_R$ | Return Pressure |
| $Q_{FR}$ | Return flow |
| $P_F$ | Furnace Pressure |
| $Q_F$ | Furnace flow |
| $Q_{CR}$ | Return Flow to air treatment |
| $Q_{CD}$ | Distribution flow from air treatment |
| $Q_{RB}$ | Return by-pass flow from manifold element |
| $P_D$ | Distribution pressure |
| $Q_{FD}$ | Distribution flow |

The results of the tests for the system configuration shown in FIG. 19 are set out in table 2 which follows:

TABLE 2

| | $P_R$ (in. w. g.) | $Q_{FR}$ ($ft^3$/min) | $Q_F$ ($ft^3$/min) | $P_F$ (in. w. g.) | $Q_{CD}$ ($ft^3$/min) | $Q_{CR}$ ($ft^3$/min) | $Q_{RB}$ ($ft^3$/min) | $P_D$ (in. w. g.) | $Q_{FD}$ ($ft^3$/min) |
|---|---|---|---|---|---|---|---|---|---|
| Furnace Only | 0.1 | 866 | 866 | 0.4 | 0 | 0 | 0 | 0.3 | 866 |
| Furnace + Air treatment unit | 0.11 | 960 | 910 | 0.45 | 269 | 269 | 218 | 0.29 | 960 |
| Air treatment unit Only | 0.01 | 231 | 1 | 0 | 288 | 288 | 51 | 0.01 | 0 |

As may be seen from Tables 1 and 2 the an advantage of an air handling system of the present invention is to be able to minimize pressure (increase) at the furnace when a device (e.g. humidifier, air exchanger, optional filters or similar devices) is connected to an existing ducting network.

Referring to FIG. 18, without the reflux ducting system, when the furnace and air treatment unit are both on, the pressure level at the furnace can become higher than the level allowed by the automatic safety device of the furnace which is around 0.60 in. w.g. Table 1 shows that parameter $P_F$ (which is the pressure read by the furnace) easily reaches 0.60 in. w.g. level causing the furnace to stop. Table 1 also shows that just before reaching the 0.60 in. w.g. level, total airflow passing through the furnace ($Q_F$) is reduced by 74 CFM (792 CFM).

Referring to FIG. 19 and table 2 when the furnace and air treatment unit are both on, parameter $P_F$ reaches only 0.45 in. w.g. which is down to the safe operating range of the furnace. In this case, total airflow passing through the furnace ($Q_F$) is 910 CFM, which is about 118 CFM higher than in the system shown in FIG. 18. Thus a system in accordance with the present invention can benefit from an overall increase in performance as compared to a system without the reflux duct work assembly.

It is to be understood that the apparatus of the present invention may take many other forms without departing from the spirit and scope thereof as described in the present specification; the specific embodiment illustrated above being provided by way of illustrative example only.

The invention claimed is:

1. An air handling system for an indoor space comprising a forced indoor air treatment component, an input indoor air duct element and an output treated air duct element respectively coupling said indoor air treatment component to said indoor space, a forced fresh air ventilator component for discharging stale air from the indoor space to an outdoor environment and for replacing the discharged air with make-up air from the outdoor environment, said fresh air ventilator component comprising stale air input means coupled to a stale air output means and fresh make-up air input means coupled to a fresh air output means a stale air duct element coupled to said stale air input means and to said input indoor air duct element, a primary fresh air duct element coupling said fresh air output means to said output treated air duct element characterized in that said system comprises a further secondary fresh air path means coupling said fresh air output means to said input indoor air duct element, said further secondary fresh air path means comprising an air duct element having a first end coupled to said fresh air output means and a second end coupled to said input indoor air duct element a first air flow control means comprising a first damper element associated with said primary fresh air duct element, said first damper element being independently displaceable between a blocking configuration and a non-blocking configuration, a second air flow control means comprising a second damper element associated with said further secondary fresh air path means, said second damper element being independently displaceable between a blocking configuration and a non-blocking configuration, wherein in said respective blocking configuration, said first and second damper elements are respectively disposed to close off said primary fresh air duct element and said further secondary fresh air path means to air flow, and in said respective non-blocking configuration, said first and second damper elements are respectively disposed such that air is able to circulate through said primary fresh air duct element and said further secondary fresh air path means, wherein said second air flow control means is configured such that, when an indoor air treatment component air blower means associated with said forced indoor air treatment component and a ventilation air blower means associated with said forced fresh air ventilator component are both activated, said second damper element is in said non-blocking configuration and wherein said first and said second air flow control means are each configured such that, when only the ventilation air blower means is activated, said first damper element is in said non-blocking configuration and said second damper element is in said blocking configuration.

2. A system as defined in claim 1 wherein said forced indoor air treatment component is a forced air furnace component and said output treated air duct element is an output heated air duct element.

3. A system as defined in claim 2 wherein said first and said second air flow control means are each configured such that, when a furnace air blower means associated with said forced air furnace component and a ventilation air blower means associated with said forced fresh air ventilator component are both activated, said first damper element and said second damper element are each in said non-blocking configuration.

4. A system as defined in claim 2 wherein said first and said second air flow control means are each configured such that, when only a furnace air blower means associated with said forced air furnace component is activated, said first damper element and said second damper element are each in said blocking configuration.

5. A system as defined in claim 2 wherein said first and said second air flow control means are each configured such that, when both a furnace air blower means associated with said forced air furnace component and a ventilation air blower means associated with said forced fresh air ventilator component are unactivated, said first damper element and said second damper element are each in said blocking configuration.

6. A system as defined in claim 2 wherein said stale air duct element is coupled to said input indoor air duct element at a first position upstream of said forced air furnace component and said air duct element of said further secondary fresh air path means is coupled to said input indoor air duct element at a second position downstream of said first position and upstream of said forced air furnace component.

7. A system as defined in claim 2 wherein said first air flow control means comprises a first biasing element biasing said first damper element in said blocking configuration and wherein said second air flow control means comprises a second biasing element biasing said second damper element in said blocking configuration.

8. A system as defined in claim 2 wherein said primary fresh air duct element comprises a manifold component, said manifold component comprising an air inlet, a first air outlet and a second air outlet, said air inlet being coupled to said fresh air output means, said first air outlet being coupled to said output heated air duct element and said first end of said air duct element of said further secondary fresh air path means being coupled to said second air outlet.

9. A system as defined in claim 8 wherein said first damper element is associated with said first air outlet.

10. A system as defined in claim 9 wherein, said second damper is associated with said second air outlet.

11. A system as defined in claim 2 wherein said forced fresh air ventilator component comprises heat recovery means for exchanging heat between said stale air and said make-up air.

12. A system as defined in claim 2 comprising control means electrically coupled to a furnace blower means associated with said forced air furnace component and a ventilation air blower means associated with said forced fresh air ventilator component for independently electrically actuating same.

13. A system as defined in claim 7 wherein said first air flow control means and said second air flow control means are each configured such that said first damper element and said second damper element are each respectively air pressure displaceable from said blocking configuration to said non-blocking configuration.

14. A system as defined in claim 8 wherein said stale air duct element is coupled to said input indoor air duct element at a first position upstream of said forced air furnace component and said second end of said air duct element of said further secondary fresh air path means is coupled to said input indoor air duct element at a second position downstream of said first position and upstream of said forced air furnace component.

15. A system as defined in claim 14 wherein said first air flow control means comprises a first biasing element biasing said first damper element in said blocking configuration and wherein said second air flow control means comprises a second biasing element biasing said second damper element in said blocking configuration.

16. A system as defined in claim 15 wherein said first air flow control means and said second air flow control means are each configured such that said first damper element and said second damper element are each respectively air pressure displaceable from said blocking configuration to said non-blocking configuration.

17. A system as defined in claim 16 wherein said forced fresh air ventilator component comprises heat recovery means for exchanging heat between said stale air and said make-up air.

18. A system as defined in claim 17 wherein said first damper element is associated with said first air outlet.

19. A system as defined in claim 18 wherein, said second damper element is associated with said second air outlet.

20. A system as defined in claim 19 wherein said first and said second air flow control means are each configured such that, when only a furnace air blower means associated with said forced air furnace component is activated, said first damper element and said second damper element are each in said blocking configuration.

* * * * *